US007148815B2

(12) United States Patent
Derringer

(10) Patent No.: US 7,148,815 B2
(45) Date of Patent: Dec. 12, 2006

(54) APPARATUS AND METHOD FOR DETECTING OBJECTS LOCATED ON AN AIRPORT RUNWAY

(76) Inventor: Byron Scott Derringer, 900 N. Stafford St., Suite 1914, Arlington, VA (US) 22203

( * ) Notice: Subject to any disclaimer, the term of this patent is extended or adjusted under 35 U.S.C. 154(b) by 0 days.

(21) Appl. No.: 09/988,376

(22) Filed: Nov. 19, 2001

(65) Prior Publication Data

US 2002/0080046 A1 Jun. 27, 2002

Related U.S. Application Data

(63) Continuation-in-part of application No. 09/742,540, filed on Dec. 22, 2000, now abandoned.

(51) Int. Cl.
*G08G 5/04* (2006.01)

(52) U.S. Cl. ..... 340/961; 340/556; 340/945

(58) Field of Classification Search ..... 340/557, 340/556, 904, 959, 961, 963, 945; 342/57
See application file for complete search history.

(56) References Cited

U.S. PATENT DOCUMENTS 2,649,538 A * 8/1953 Marlowe et al. ..... 340/552
3,623,057 A * 11/1971 Hedin et al. ..... 340/557
3,641,549 A * 2/1972 Misek et al. ..... 340/526
3,971,025 A * 7/1976 Levine ..... 342/410
3,987,428 A * 10/1976 Todeschini ..... 340/557
4,319,332 A * 3/1982 Mehnert ..... 342/27
4,481,516 A * 11/1984 Michelotti ..... 340/933
5,063,288 A * 11/1991 Hsu et al. ..... 250/221
5,189,425 A * 2/1993 Dabbs ..... 342/52
5,198,799 A * 3/1993 Pascale ..... 340/552
5,375,058 A * 12/1994 Bass ..... 701/120
5,448,243 A * 9/1995 Bethke et al. ..... 342/59
5,469,371 A * 11/1995 Bass ..... 342/450
5,471,214 A 11/1995 Faibish et al. ..... 342/70
5,508,697 A * 4/1996 Kato et al. ..... 340/933
5,554,972 A * 9/1996 Byrne ..... 340/556
5,574,426 A 11/1996 Shisgal et al.
5,629,691 A * 5/1997 Jain ..... 340/961
5,680,120 A * 10/1997 Tilleman ..... 340/904
5,689,239 A 11/1997 Turner et al.
5,779,349 A 7/1998 Reinert, Sr.
5,793,329 A 8/1998 Nakada et al.
5,815,411 A 9/1998 Ellenby et al.
5,841,443 A 11/1998 Einkauf
5,848,377 A 12/1998 Wong
5,871,018 A 2/1999 Delp et al.

(Continued)

OTHER PUBLICATIONS

David Hughes, "Tackling Runway Incursions," *Aviation Week & Space Technology*, Oct. 27, 2003, pp. 44-45.

(Continued)

*Primary Examiner*—Brent A. Swarthout

(57) ABSTRACT

An apparatus for detecting objects on an airport runway. The apparatus comprises a first transmitter adapted to be positioned adjacent to the runway, a first receiver adapted to be positioned adjacent to the runway, a processor operably linked to the first receiver, and a user interface operably linked to the processor. The first transmitter is adapted to emit a first beam of light across the runway to the first receiver and the first receiver is adapted to send a first indication to the processor if the first beam of light is interrupted by an object on the runway. The processor is adapted to send a warning indication to the user interface in response to the first indication and the user interface is adapted to generate a warning upon receipt of the warning indication.

32 Claims, 31 Drawing Sheets

U.S. PATENT DOCUMENTS

| | | | | |
|---|---|---|---|---|
| 5,949,976 | A | 9/1999 | Chappelle | |
| 5,999,662 | A | 12/1999 | Burt et al. | |
| 6,005,513 | A | 12/1999 | Hardesty | |
| 6,028,624 | A | 2/2000 | Watkins | |
| 6,031,934 | A | 2/2000 | Ahmad et al. | |
| 6,033,083 | A * | 3/2000 | Reinert, Sr. | 362/153.1 |
| 6,034,760 | A | 3/2000 | Rees | |
| 6,075,898 | A | 6/2000 | Chase | |
| 6,130,626 | A | 10/2000 | Kane et al. | |
| 6,246,342 | B1 * | 6/2001 | Vandevoorde et al. | 340/961 |
| 6,295,007 | B1 * | 9/2001 | O'Meara | 340/953 |
| 6,486,825 | B1 * | 11/2002 | Smithey | 342/29 |
| 6,850,185 | B1 * | 2/2005 | Woodell | 342/30 |

OTHER PUBLICATIONS www.steinbichler.de/digitizing/index.html, home page printed Feb. 11, 2004.
www.micro-epsilon.com/index_en.html, home page printed Feb. 11, 2004.
www.scs.carleton.ca/~miles/research/threedmod/chapt2.html web page.
www.sensorsmag.com/articles/0702/laser/main.shtml, home page printed Feb. 11, 2004.
www.moduloc-usa.com, home page printed Feb. 11, 2004.
www.photonics.com, home page printed Feb. 11, 2004.
www.spawar.navy.mil/robots/pubs/td2734.pdf, home page printed Feb. 11, 2004.
www.riftek.com, home page printed Feb. 11, 2004.
www.cat.ernet.in, home page printed Feb. 11, 2004.
www.optical-metrology-centre.com, home page printed Feb. 11, 2004.
www.sensors-uk-transducers-instruments.com, home page printed Feb. 11, 2004.
www.meos.com, home page printed Feb. 11, 2004.
www.iop.org, home page printed Feb. 11, 2004.
www.acuityresearch.com, home page printed Feb. 11, 2004.
www.edmundoptics.com, Alex Pete et al., "Fundamentals of Lasers," printed Nov. 28, 2003.
www.endmundoptics.com, "Frequently Asked Questions on Lasers," printed Nov. 28, 2003.
www.endmundoptics.com, "Laser Diode Selection Guide," printed Nov. 28, 2003.
www.endmundoptics.com, Alex Pete, "Using Laser Beam Expanders," printed Dec. 3, 2003.
www.endmundoptics.com, Jeremy Govier et al., "Tackling Laser Visibility," printed Nov. 28, 2003.
www.trescray.co.uk.hottop/fags.htm, Frequently asked questions, printed Nov. 24, 2003.
www.automaticsystems.com, Projects Portfolio, printed Nov. 24, 2003.
www.ecmweb.com, Paul Rosenberg, Facility Security: Intrusion Systems, printed Nov. 24, 2003.
www.acisecurity.com, home page printed Nov. 24, 2003.
www.zarebasecurity.com, Sensor Systems, printed Nov. 24, 2003.
www.defense-update.com, Tactical High Energy Laser (THEL) Program, printed Nov. 24, 2003.
http://content.honeywell.com, Honeywell and Coherent Technologies to Provide US Army with Multi-Mode Infra-Red Radar (MMIRR), printed Nov. 28, 2003.
www.acisecurity.com, Optical Safety Systems, printed Nov. 24, 2003.
www.boschsecurity.com, DS416 Photoelectric Beam Detector, printed Nov. 24, 2003.
www.lineardetection.com, Linear Optical Detection—Products & Manuals, printed Nov. 21, 2003.
www.lineardetection.com, Optical Linear Detection Products: Fireray 50 +100 (Reflective Beam Smoke Detectors), printed Nov. 21, 2003.
www.lineardetection.com, Optical Linear Detection Products: Fireray 2000 (Optical Beam Smoke Detectors), printed Nov. 21, 2003.
www.lineardetection.com, Optical inear Detection Products: Fireray EExd (Flameproof Fire Detection), printed Nov. 21, 2003.
Fireray 2000 Installation Guide, pp. 1-8.
Honeywell International, Inc., Dec. 2002, Safety multibeam system for access detection with integrated muting function.
www.hissink.nl/nl/dept_239.html, Detectors, printed Nov. 28, 2003.
Fireray 50/100R, Fire Fighting Enterprises Ltd., pp. 1-9.
www.airportsystems.honeywell.com, Visual Docking Guidance System, 2002 Honeywell International, Inc.
http://airportsystems.honeywell.com/dockingguidance, Honeywell Airport Systems, printed Nov. 28, 2003.
www.airportsystems.honeywell.com, Airport Traffic Sensorsystem (ATS), 2002 Honeywell International, Inc.
www.airportsystems.honeywell.com, Airfield Lighting Calm System, 2002 Honeywell International, Inc.
www.samadhi.ipl.nasa.gov, Global positioning System (GPS), printed Nov. 28, 2003.
www.interoceansystems.com, Oil Spill Detection System, printed Nov. 21, 2003.
www.interoceansystems.com, Software and Accessories, printed Nov. 21, 2003.
www.interoceansystems.com, S4 Application Software for Windows, printed Nov. 21, 2003.
www.acisecurity.com, RoofGuard Alarms, printed Nov. 24, 2003.
www.wg-plc.com, Perimeter Security, printed Nov. 24, 2003.
Fiber SenSys., Inc., 1998, A New Processor For Proven Fiber-Optic Sensing Systems.
www.abelalarm.co.uk/html/neteye_gold_spec.html, NetEye Gold Specifications, printed Nov. 21, 2003.
www.geoffreyaccess.com.
www.auratek.net, SURENET-V, Diagnostic and Alarm Reporting Software, printed Nov. 21, 2003.
Ericsson Microelectronics AB, Jun. 2000, PKN 4000 PI Single Output—Alarm and Control Functions.

* cited by examiner

APPARATUS AND METHOD FOR DETECTING OBJECTS LOCATED ON AN AIRPORT RUNWAY

CROSS REFERENCE TO RELATED PATENT APPLICATION

This application is a continuation-in-part of, and claims priority on, U.S. patent application Ser. No. 09/742,540 for METHOD AND APPARATUS FOR WARNING AND DETECTING DEBRIS LOCATED ON AIRPORT RUNWAY SURFACE, filed on Dec. 22, 2000 now abandoned.

FIELD OF THE INVENTION

The present invention relates to an apparatus and method for detecting objects located on an airport runway. More particularly, the present invention is an apparatus and method employing optical transmitters, transceivers, receivers, reflectors, and various processing means for detecting objects located on an airport runway.

BACKGROUND OF THE INVENTION

The problems associated with objects located on airport runway surfaces during aircraft landing and take off have long been recognized. There have been repeated catastrophes associated with objects or other debris on airport runway surfaces involving deaths of thousands of people and damage to aircraft. Aircraft are operated by pilots often unfamiliar with individual airports and runways, and possibly without adequate visibility during take off or landing. Even the presence of air traffic control does not wholly eliminate the hazard of unseen objects on the runway to the aircraft and its passengers.

There are many recent articles relating to aircraft catastrophes in relation to the presence of objects or other debris on airport runway surfaces. Examples of such articles include the following references, the disclosure of which are hereby incorporated by reference:

Alan Cowell, *Concorde is Stripped of Certification to Fly*, N.Y. Times, Aug. 17, 2000, Foreign Desk; Suzanne Daley, *Recorders Show 2 Engines in Trouble Before Paris Crash*, N.Y. Times, Jul. 28, 2000, Foreign Desk; Erik Eckholm, *Airline Says Jet Was on Wrong Runway Before Crash in Taiwan*, N.Y. Times, Nov. 4, 2000, Foreign Desk; Erik Eckholm, *Taiwan Crash Recorders Checked; No Theories Ruled Out*, N.Y. Times, Nov. 2, 2000, Foreign Desk; Donald G. McNeil Jr., *A Key Runway Inspection Was Skipped the Day of the Concorde Crash, Investigators Report*, N.Y. Times, Sep. 2, 2000; and *Pilots' 'Dreadful Mistake' in Taiwan May Lead to Jail*, N.Y. Times, Nov. 5, 2000, Foreign Desk.

Applicant is unaware of any information regarding past prior art similar to the present invention for a sensing system for detecting objects or other debris that may be hazardous to aircraft and/or passengers on an airport runway surface.

Consequently, due to recent aviation catastrophes or near disasters that are attributable to objects or other debris on the airport runway surface when the aircraft are either taking off or landing, there is a need to develop an apparatus and system to locate, characterize, and alert appropriate airport personnel to the presence of objects or other debris on airport runways.

It is known that the Supersonic Air France Concorde crash on Jul. 26, 2000 was attributed to objects or other debris left on the airport runway prior to the Concorde's departure from Charles de Gaulle Airport in France. French investigators indicated that "a 16-inch piece of metal on the runway had burst the tire, setting off the sequence of apparently freakish events that caused the plane to crash within 90 seconds" after takeoff. Alan Cowell, *Concorde Is Stripped of Certification to Fly*, N.Y. Times, Aug. 17, 2000, Foreign Desk. In fact, it has been said that "objects or other debris on the runway [is] most often the problem" in catastrophes when aircraft are landing and taking off. Suzanne Daley, *Recorders Show 2 Engines in Trouble Before Paris Crash*, N.Y. Times, Jul. 28, 2000, Foreign Desk. Most importantly, the present invention may alleviate the problem of "inspections [being] skipped" and ensure that airport runway surfaces would be clear of any objects or other debris. Donald G. McNeil Jr., *A Key Runway Inspection Was Skipped the Day of the Concorde Crash, Investigators Report*, N.Y. Times, Sep. 2, 2000.

In a more recent catastrophe involving an airline in Taiwan, killing 80 people, the pilot was unaware of his surroundings and claimed that "from beginning to end, didn't know he was using the wrong runway" during take off. Apparently, this is a common mistake due to location of the pilot in the aircraft, the familiarity of the pilot with the airport, or other visibility issues. The present invention would allow air traffic control or other personnel to assess the location of any aircraft on any runway as well as the condition of the runway surface prior to clearing the aircraft for takeoff. Understanding that the air traffic control tower in this incident did not have the best view, the present invention would provide another method to double check the runway prior to clearing an aircraft for takeoff. Erik Eckholm, *Airline Says Jet Was on Wrong Runway Before Crash in Taiwan*, N.Y. Times, Nov. 4, 2000, Foreign Desk. Considering all factors in the tragic airline crash in Taiwan, the present invention would help prevent an aircraft from traveling down "a runway that was closed for repairs and littered with heavy digging equipment". *Pilots' 'Dreadful Mistake' in Taiwan May Lead to Jail*, N.Y. Times, Nov. 5, 2000, Foreign Desk.

However, despite this prior public knowledge, Applicant is unaware of any known, proposed, or successfully implemented sensing systems for detecting objects or other debris on an airport runway surface which would provide an advance warning to air traffic control and airport ground based personnel.

Consequently, there exists a need to detect such objects or other debris on runway surfaces.

Furthermore, there exists a need to notify air traffic control and ground based personnel of such objects or other debris prior to aircraft takeoff or landing.

OBJECTS OF THE INVENTION

An object of the present invention is to provide a novel apparatus and method for detecting objects or other debris on airport runway surfaces that may pose a hazard to aircraft and passengers.

An object of the present invention is to provide a novel apparatus and method that can detect objects or other debris on an airport runway surface and provide an early warning signal to the aircraft, air traffic control, and/or ground based personnel.

An object of the present invention is to provide a novel apparatus and method that can provide information to the aircraft, air traffic control, and/or ground based personnel prior to aircraft landing and takeoff, thus providing time for corrective action to clear the airport runway surface prior to landing and takeoff. Air traffic control and ground based personnel may be provided with prior knowledge of objects or other debris prior to aircraft touch down on the airport runway surface.

An object of the present invention is to provide a novel apparatus and method that may direct one or more laser beams across an airport runway surface that may contain objects or other debris. As a result of the novel apparatus, the invention can provide a sufficient period of time for the aircraft, air traffic control, and/or ground based personnel to take corrective action to avoid the hazardous conditions.

Optical laser systems that would be used in conjunction with the present invention would depend on the different weather conditions that may be present, such as, but not limited to, fog, rain, ice, snow, wind, dust, or any other type of inclement weather or adverse conditions.

An object of the present invention is to provide a novel apparatus and method that can provide information directly to air traffic control and/or ground based personnel from one, or several laser beams located on the perimeter of the airport runway surface in order to provide the necessary information to direct the approach, landing, or takeoff of an aircraft.

SUMMARY OF THE INVENTION

Responsive to the foregoing challenges, Applicant has developed an innovative apparatus and method for detecting objects on an airport runway comprising: an optical system; an object location processor operably linked to the optical system; an object characterizer operably linked to the object location processor; an alarm activation processor operably linked to the object characterizer; an alarm generator operably linked to the alarm activation processor; and a user interface operably linked to the alarm generator.

The optical system may further comprise one or more optical transmitters and one or more optical receivers, and/or one or more optical transceivers and one or more optical reflectors, or any combination of transmitters, receivers, transceivers, and reflectors. The object location processor may further comprise an intrusion sensor detection system, an operation sensor detection system, and/or an output inspector diagnostic system.

The object characterizer may further comprise a motion detection processor. The user interface may further comprise a graphical interface, a no alarm indicator, a future risk indicator, and/or an imminent danger indicator.

The apparatus may comprise a support mechanism for the optical system, and the support mechanism may further comprise means for adjusting the height of the support mechanism and/or the height of the optical system. The support mechanism may further comprise means for heating the support mechanism and/or the optical system. The apparatus may comprise a protective cover for the optical system.

An alternative preferred embodiment of the present invention is an apparatus and method for detecting objects or other debris located on an airport runway surface comprising: one or more optical laser transmitters and one or more optical laser receivers for sensing the presence of objects on an airport runway surface, and/or comprising a plurality of optical laser transmitters arranged to transmit optical laser beams across portions of the runway surface; a plurality of optical laser receivers arranged to receive the optical lasers, and processing means to process signals from the plurality of optical laser receivers to determine the presence of an object on the runway.

The apparatus may further comprise reflectors arranged to reflect the optical lasers to the optical laser receivers, and one or more optical laser transceivers and one or more optical laser reflectors for sensing the presence of objects on an airport runway surface.

There is thus provided in accordance with a preferred embodiment of the present invention an apparatus and method for warning and detecting objects or other debris located on airport runway surface, comprising: optical laser transmission and receiving apparatus for sensing the presence of objects or other debris within a spatial range relative to an aircraft; optical laser transceiver and reflector apparatus for sensing the presence of objects or other debris within a spatial range relative to an aircraft; multiple objects or other debris processing apparatus receiving an output from the optical laser transmission and receiving apparatus for tracking a plurality of objects or other debris sensed by the optical laser transmission and receiving apparatus; multiple objects or other debris processing apparatus receiving an output from the optical laser transceiver and reflector apparatus for tracking a plurality of objects or other debris sensed by the optical laser transceiver and reflector apparatus; auxiliary non-optical laser objects or other debris sensing apparatus; and alarm processing apparatus receiving an input from the non-optical system components, including, but not limited to, the object location processor, the object characterizer, and the alarm activation processor, or other debris sensing apparatus for indicating the alarm status of an object and providing an output indication to alarm generating apparatus.

In accordance with a preferred embodiment of the present invention, the non-optical system or other debris sensing apparatus processing means may be in communication with an optical laser transmitter and optical laser receiver. Also, in accordance with a preferred embodiment of the present invention, the non-optical laser system or other debris sensing apparatus processing means may be in communication with a laser energy transceiver and reflector.

Additionally in accordance with an embodiment of the present invention, the system can also include alarm generating apparatus for providing an indication of alarm status to air traffic control and ground based personnel. Preferably, the optical laser transmission and receiving apparatus includes plural optical laser apparatus.

In accordance with a preferred embodiment of the present invention, the plural optical laser apparatus includes at least one optical laser for sensing location. Preferably, the plural optical laser apparatus includes a plurality of optical laser apparatus for objects or other debris detection.

In accordance with a preferred embodiment of the present invention, the plurality of optical laser apparatus are arranged such that their detection regions are distributed in partially overlapping orientation in azimuth fashion, thereby covering the airport runway surface. Preferably, the optical laser transmission and receiving apparatus also includes apparatus for comparing the outputs of more than one of the plurality of optical laser relating to a given object in order to define the angular position of the object with enhanced resolution.

In accordance with a preferred embodiment of the present invention, at least one of the optical laser transmission and receiving apparatus and the multiple objects or other debris optical laser apparatus includes a motion processor apparatus for distinguishing moving objects or other debris from stationary objects or other debris.

Additionally, in accordance with a preferred embodiment of the present invention, at least one of the optical laser transceiver and reflector apparatus and the object characterizer apparatus include apparatus for distinguishing moving objects or other debris from stationary objects or other debris. Preferably, the object characterizer apparatus provides an output indication of the velocity vector of a plurality of moving objects or other debris.

Additionally, in accordance with a preferred embodiment of the present invention, the object characterizer apparatus includes apparatus for disregarding objects or other debris whose vectors do not fit within a predetermined profile.

Further in accordance with a preferred embodiment of the present invention, the object characterizer apparatus includes apparatus for disregarding objects or other debris whose vectors do not fall within a danger envelope defined with respect to the landing and take off vector of an aircraft. Characteristics of the aircraft such as a proximity to objects or other debris are also termed herein "own" characteristics, such as "own proximity to objects or other debris".

In accordance with a preferred embodiment of the present invention, the auxiliary non-optical laser system or other debris sensing apparatus includes optical laser apparatus for defining first and second generally vertical beam walls which delimit a range of protection with respect to a protected aircraft.

Additionally, in accordance with a preferred embodiment of the present invention, the auxiliary non-optical laser system or other debris sensing apparatus includes optical laser apparatus for defining a generally horizontal beam fan spaced from the airport runway surface which at least partially delimits a range of protection with respect to a protected aircraft.

Further in accordance with a preferred embodiment of the present invention, the system also includes operation sensors and output inspector apparatus for sensing impaired operation of the optical laser system or other debris sensing apparatus and for modifying the operation of the system in accordance therewith. In accordance with a preferred embodiment of the present invention, the apparatus for sensing and modifying includes apparatus for operating the optical laser transmitting and receiving apparatus in an occupancy probability sensing mode of operation.

There is also provided in accordance with a preferred embodiment of the present invention a method for warning and detecting objects or other debris located on airport runway surface including the steps of: optical laser sensing the presence of objects or other debris within a spatial range relative to the airport runway surface; multiple objects or other debris tracking a plurality of objects or other debris sensed by optical laser; sensing objects or other debris by auxiliary non-optical sensing techniques; and receiving a multiple objects or other debris tracking input and an auxiliary non-optical objects or other debris sensing input and on the basis thereof indicating the alarm status of a target and providing an output indication to air traffic control and ground based personnel.

In accordance with a preferred embodiment of the present invention, the auxiliary non-optical laser system or other debris sensing step may include a laser energy transmission and reception step. Preferably, the optical laser sensing step includes comparing the outputs of more than one of a plurality of optical-lasers relating to a given object in order to define the angular position of the object with enhanced resolution.

In accordance with a preferred embodiment of the present invention, at least one of the optical laser sensing and the multiple objects or other debris tracking steps includes distinguishing moving objects or other debris from stationary objects or other debris. Preferably, the multiple objects or other debris tracking step provides an output indication of the vector of the plurality of moving objects or other debris.

Additionally in accordance with a preferred embodiment of the present invention, the multiple objects or other debris tracking step is operative for disregarding objects or other debris whose vectors do not fit within a predetermined profile.

Further in accordance with a preferred embodiment of the present invention, the step of disregarding includes disregarding objects or other debris whose vectors do not fall within a danger envelope defined with respect to the vector of the protected aircraft.

In accordance with a preferred embodiment of the present invention, the auxiliary non-optical objects or other debris sensing step includes defining first and second generally vertical optical-laser beam walls which delimit a range of protection with respect to a protected aircraft.

Additionally in accordance with a preferred embodiment of the present invention, the auxiliary non-optical laser system or other debris sensing step includes defining a generally horizontal optical laser beam fan spaced from the airport runway surface which at least partially delimits a range of protection with respect to a protected aircraft.

Further in accordance with a preferred embodiment of the present invention, the method also includes the steps of sensing impaired auxiliary non-optical system or other debris sensing and modifying operation in accordance therewith (i.e. rain, snow, ice, fog, wind, dust, or any other type of inclement weather or adverse condition).

In accordance with a preferred embodiment of the present invention, the steps of sensing and modifying include operating the optical laser transmitting and receiving apparatus in an occupancy probability sensing mode of operation.

Additionally in accordance with a preferred embodiment of the present invention, the steps of sensing and modifying include operating the optical laser transceiver and reflector apparatus in an occupancy probability sensing mode of operation.

There are three additional advantages of the embodiments of the present invention: 1. the use of the optical laser apparatus and method allows detection of objects and other objects or other debris in weather where visibility is very low (i.e. fog or any other type of inclement weather or adverse condition), 2. the use of the method with transceiver to reflector will be more cost effective in construction based on the expense of reflectors versus receivers, and 3. prevention/warning of incursion of other aircraft within the same space.

Other objects and advantages will become apparent from reading the following detailed description of the invention wherein reference is made to the accompanying drawings.

Moreover, the above objects and advantages of the present invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the present invention are explained in greater detail by way of the drawings, where the same reference numerals refer to the same features.

DETAILED DESCRIPTION OF THE INVENTION

Definitions

In describing the present invention, the following definitions are applicable throughout.

"airport runway surface" refers to all areas and any surface in the airport region traveled by aircraft and/or passengers.

"air traffic control" refers to all personnel responsible for air traffic control, whether located in the air traffic control tower or elsewhere.

"objects or other debris" refer to any and all objects (including, but not limited to, ice, snow, pieces of aircraft, animals, ground based equipment, vehicles, etc.) located in the spatial region of the airport runway surface intended for aircraft or passenger travel.

"ground based personnel" refer to all personnel located as support located within the region of the airport.

"optical laser" refers to all optical beams traveling over the airport runway surface, which may detect objects and other debris on the airport runway surface.

Preferred Embodiments

Figure 1:
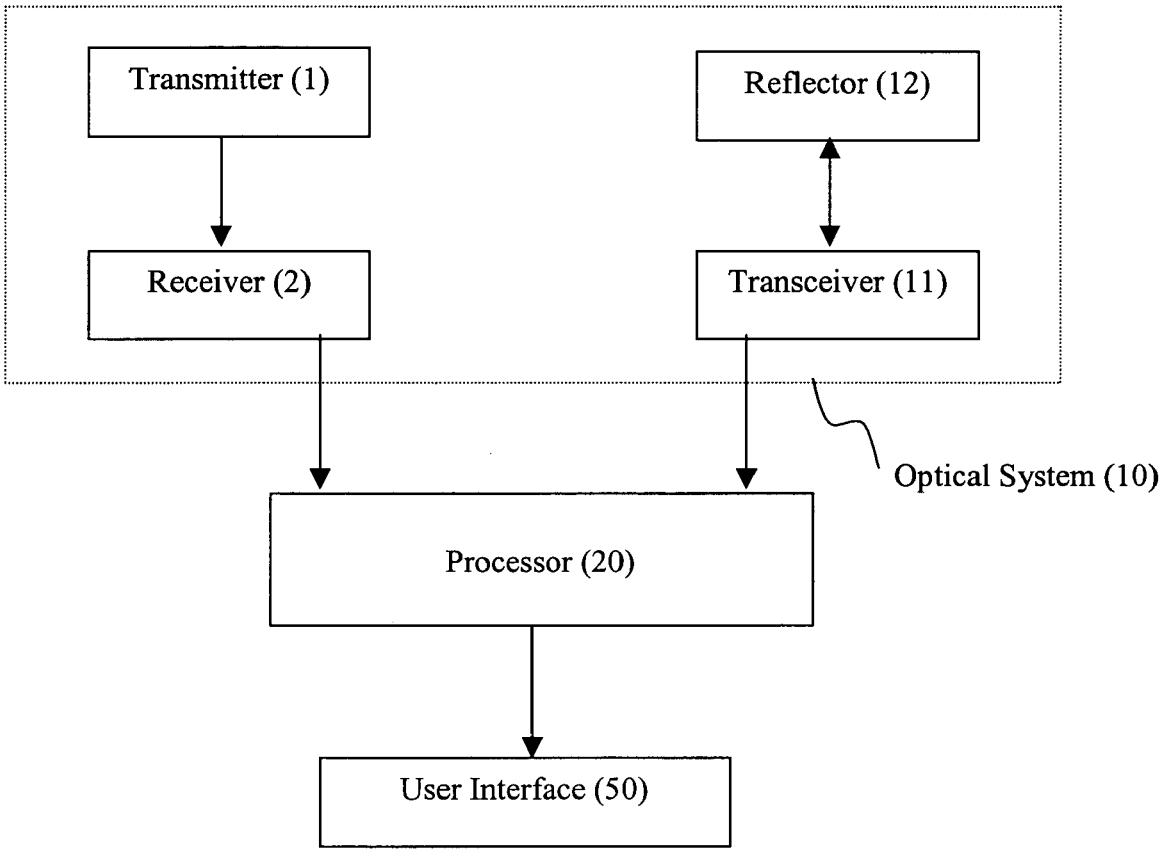
FIG. 1 is a flow diagram illustrating the apparatus and method according to a preferred embodiment of the present invention.

Reference will now be made in detail to a preferred embodiment of the present invention, an example of which is illustrated in the accompanying drawings. With reference to FIG. 1, the apparatus and method for detecting objects or other debris on an airport runway 3 comprises an optical system 10, an object location processor 20 operably linked to the optical system 10, and a user interface 50.

In an alternative preferred embodiment the optical system 10 may further comprise one or more optical transmitters 1 and one or more optical receivers 2. The optical system 10 may also comprise one or more optical transceivers 11 and one or more optical reflectors 12. The optical system 10 may also comprise any combination of optical transmitters 1, optical receivers 2, optical transceivers 11, and optical reflectors 12.

The apparatus and method may also comprise a support mechanism 6 for the optical system 10. The support mechanism 6 may further comprise means 8 for adjusting the height of the support mechanism 6 and/or the height of the optical system 10. The support mechanism 6 may further comprise heating means 13 for heating the support mechanism 6 and/or the optical system 10 to prevent the apparatus from freezing. The optical system 10 may further comprise a protective cover 14 to protect the optical system 10 from inclement weather.

An alternative preferred embodiment of the present invention is an apparatus and method for detecting objects or other debris located on an airport runway surface 3 comprising one or more optical laser transmitters 1 and one or more optical laser receivers 2 for sensing the presence of objects on an airport runway surface 3.

An alternative preferred embodiment of the present invention is an apparatus and method for detecting objects or other debris on an airport runway surface 3 comprising a plurality of optical laser transmitters I arranged to transmit optical laser beams 4 across portions of said runway surface 3 and a plurality of optical laser receivers 2 arranged to receive said optical lasers 4, and processing means 20 and 50 to process signals from said plurality of optical laser receivers 2 to determine the presence of an object on the runway surface 3. The apparatus and method may also comprise one or more optical laser transceivers 11 and one or more optical laser reflectors 12 for sensing the presence of objects on an airport runway surface.

In an alternative preferred embodiment of the present invention, optical laser transceivers 11 and optical laser reflectors 12 are arranged to reflect said optical lasers 4 back to the transceiver 11, and/or to optical laser receivers 2.

An alternative preferred embodiment of the present invention is a method for detecting objects on an airport runway comprising detecting the presence of an object on the airport runway 3 by the object's interruption of one or more optical laser beams 4 generated by an optical system 10, processing the output from the optical system 10 to determine the location of the object on the runway 3, and transmitting the information regarding the object to appropriate personnel. The method may further comprise the step of processing the output from the optical system 10 to determine the type of object on the runway 3. The method may further comprise transmitting the information to a user inter-face to alert appropriate personnel. An alternative preferred embodiment of the above method comprises the steps of detecting the presence of an object on an airport runway by the object's interruption of one or more optical laser beams generated by an optical system, processing the output from the optical system to determine the location of the object on the runway, processing the output from the optical system to determine the type of object on the runway, processing the output from the optical system to determine the appropriate degree of danger posed by the presence of the object on the runway, and transmitting the information regarding the object to a user interface.

The following embodiments and examples discussed herein are non-limiting examples.

EXAMPLE 1

Figure 2:
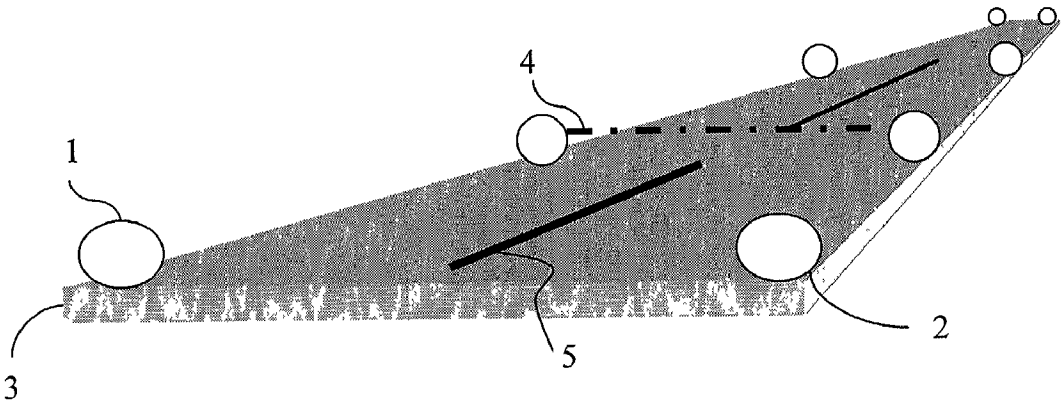
FIG. 2 illustrates a 3-dimensional frontal view of the airport runway surface with optical laser embodiments present.

Reference is now made to FIG. 2 illustrating a 3-dimensional frontal view of the airport runway surface 3, with the center line 5 marking the width in an equal distance to both edges of the airport runway surface 3. The optical laser transmitter 1 which supplies the optical laser 4 to the optical laser receiver 2 is preferably located at the edge of the airport runway surface 3.

In the different configurations of embodiments that follow, transmitter 1 can also be used as a transceiver 11 with respect to receiver 2 and reflector 12. The location of the optical laser receiver 2 can be located on the opposite side facing back in the direction of the optical laser transmitter 1. Both the optical laser transmitter 1 and optical laser receiver 2 are positioned along the width down the length of the entire airport runway surface 3.

Figure 3:
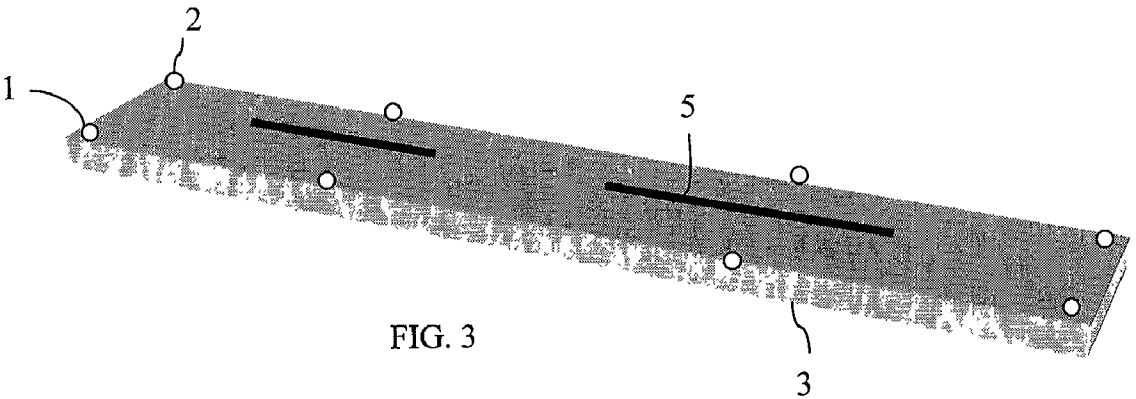
FIG. 3 is a 3-dimensional side view of the airport runway surface with optical laser embodiments present around the perimeter.

FIG. 3 illustrates the side view of a 3-dimensional airport runway surface 3 with the center line 5 marking the width in an equal distance to both edges, both optical laser transmitter 1 and optical laser receiver 2 are located around the parameter.

EXAMPLE 2

Figures 4, 4A:
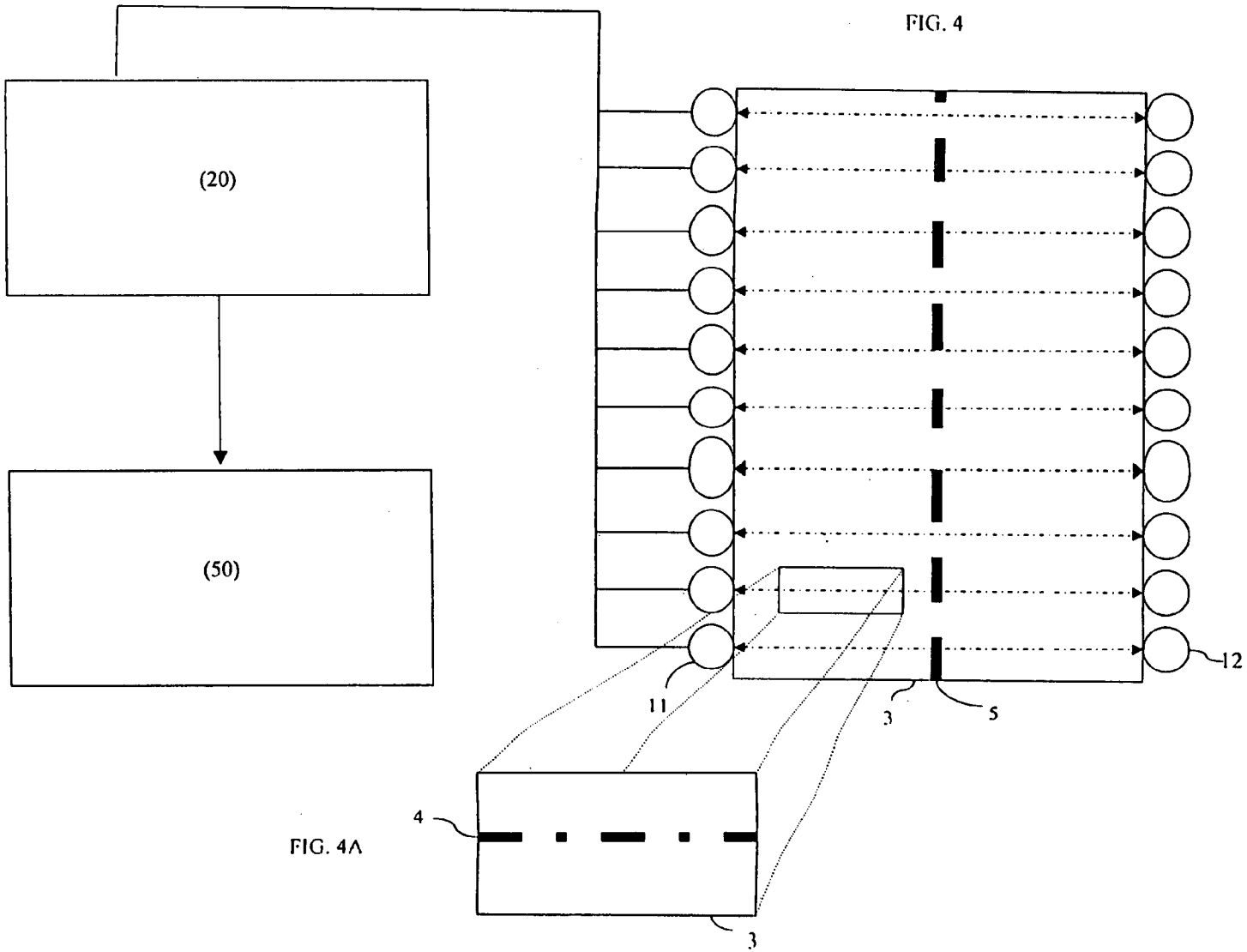
FIG. 4 is a top view of the airport runway surface with optical laser embodiments present on both sides showing laser beam configuration covering width of area specified in both directions constantly traveling through several different planes.
FIG. 4A is a simplified description of the path for the optical laser.

FIG. 4 illustrates a top view of the airport runway surface 3 with optical laser transceivers 11 and optical laser reflectors 12 on opposite sides of the airport runway surface 3. This configuration illustrates the arrangement of the optical laser 4 as magnified in FIG. 4A, which shows the configuration covering the width of the runway area specified. The optical laser 4 may be constantly traveling through several different planes while passing over the width of the airport runway surface 3.

Figures 5, 5A:
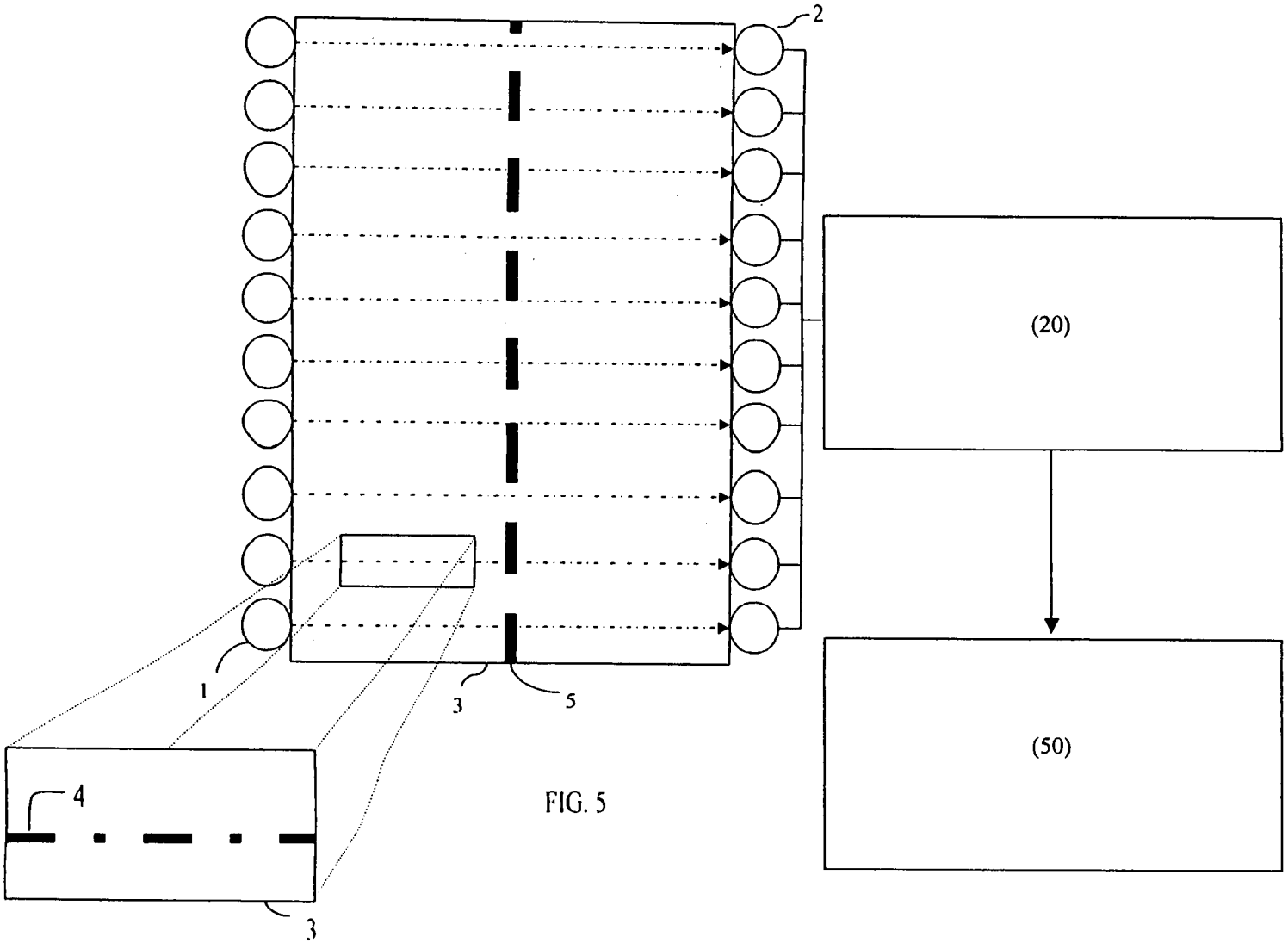
FIG. 5 is a top view of the airport runway surface with optical laser embodiments present on both sides showing laser beam configuration covering width of area specified in one direction constantly traveling through several different planes.
FIG. 5A is a simplified description of the path for the optical laser.

FIG. 5 illustrates a top view of the airport runway surface 3 showing the location of optical laser transmitters 1 on one side of the airport runway surface 3, and optical laser receivers 2 on the opposite side. The laser beam 4 as magnified in FIG. 5A illustrates the configuration covering the width of the area specified showing the direction from one side to the other and constantly traveling through several different planes.

EXAMPLE 3

Figure 6:
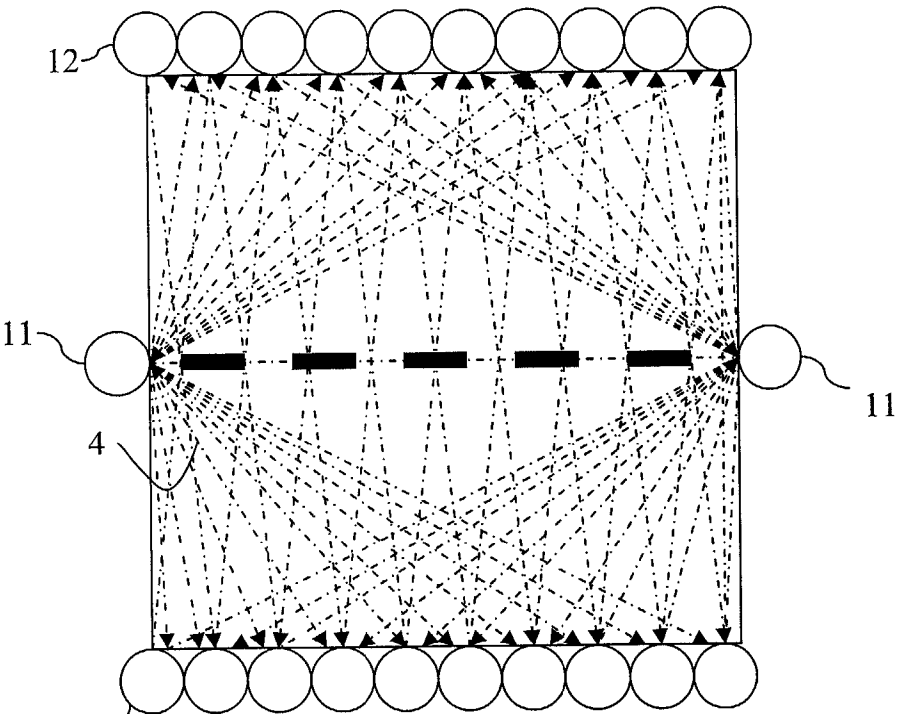
FIG. 6 is a top view of the airport runway surface with optical laser embodiments present on both sides and on each end showing a laser beam configuration covering the length and width of area specified in three different directions constantly traveling through several different planes.

FIG. 6 is a top view of the airport runway surface 3 with optical laser transceivers 11 located on each end of the airport runway surface 3 on the center line 5 marking the width in an equal distance to both edges. Optical laser reflectors 12 are present on both sides of the runway surface 3 covering the length and width of area specified by reflecting optical lasers 4 from optical laser transceivers 11 in different directions, for example, three different directions, while constantly traveling through several different planes.

Figure 6A:
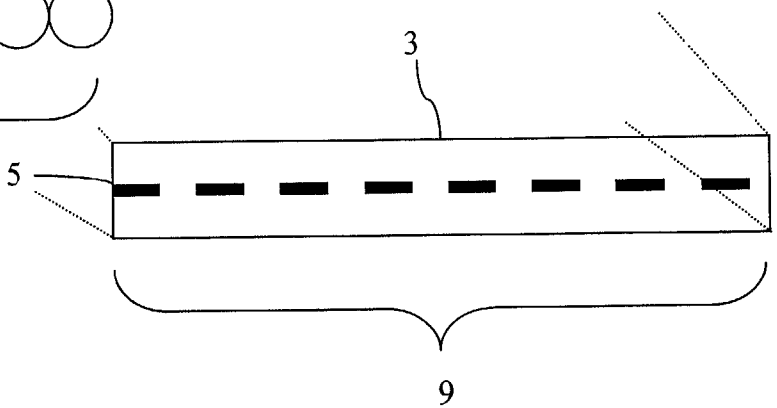
FIG. 6A is a simplified top view of the airport runway surface illustrating where an optical laser would provide protection for aircraft in landing and take off sections of the airport runway surface.

FIG. 6A is a simplified top view of the airport runway surface 3 illustrating where optical lasers 4 provide protection for aircraft within landing and take off sections 9 of the airport runway surface 3.

EXAMPLE 4

Figure 7:
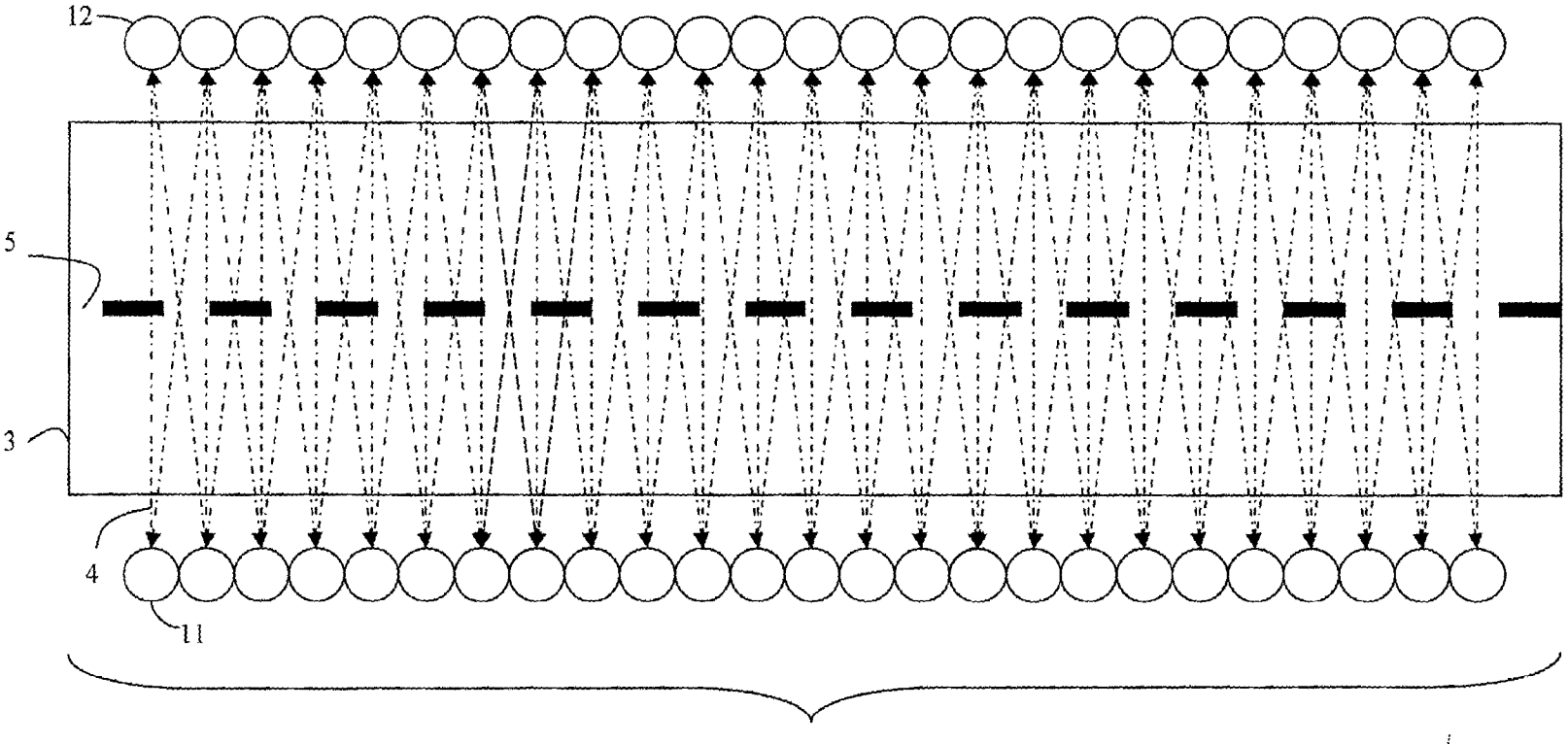
FIG. 7 illustrates a top view of the entire airport runway surface with optical laser embodiments present on both sides showing a laser beam configuration covering the width of area specified in both directions constantly traveling through several different planes.

FIG. 7 illustrates a top view of the entire airport runway surface 3 with optical laser transceivers 11 located on one side of the airport runway surface 3, opposite of the optical laser reflectors 12. The area of coverage is shown with the optical laser beams 4 traveling across the width of the airport runway surface 3 in a configuration covering the width of area specified in both directions while constantly traveling through several different planes.

Figure 7A:
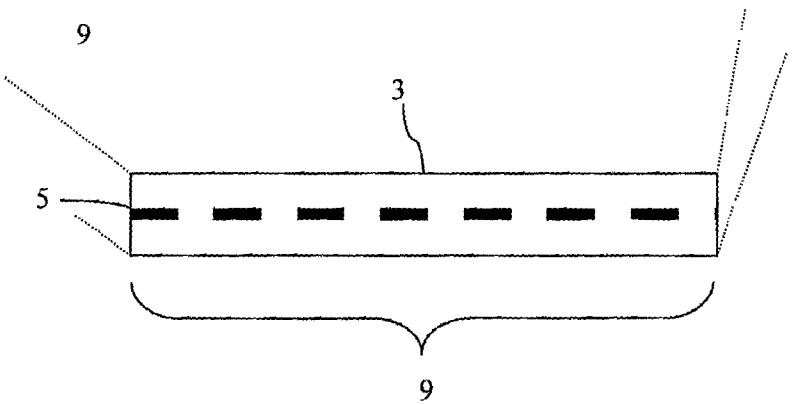
FIG. 7A is a simplified top view of the airport runway surface illustrating where optical laser would provide protection for aircraft in landing and take off sections of the airport runway surface.

FIG. 7A is a simplified top view of the airport runway surface 3 illustrating where optical lasers 4 would provide protection for aircraft within landing and take off sections 9 of the airport runway surface 3.

EXAMPLE 5

Figure 8:
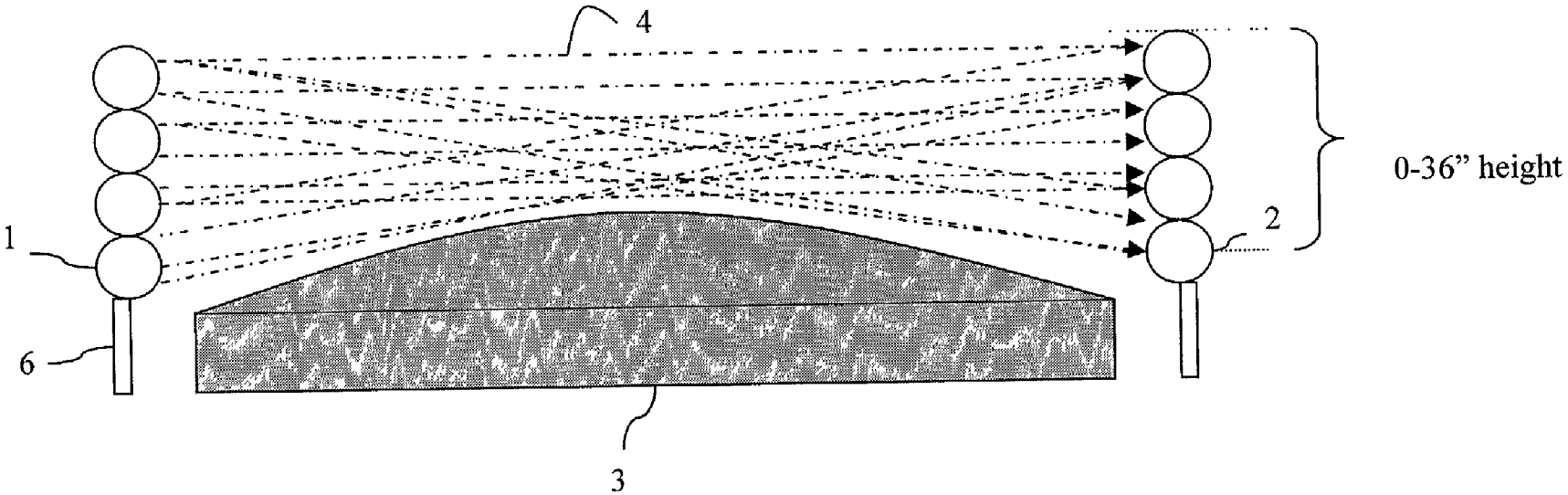
FIG. 8 is a front view of a convex airport runway surface with optical laser embodiments present on both sides showing a laser beam configuration covering the width of the area specified in one direction from left to right constantly traveling through several different planes.

FIG. 8 is a front view of a convex airport runway surface 3 with optical laser transmitters 1 located on one side of the supporting mechanism 6, opposite of the optical laser receivers 2 located on the other side of the runway surface 3, also located on the supporting mechanism 6. The direction of the optical lasers 4 show the configuration covering the width of the area specified in one direction from left to right while constantly traveling through several different planes, for example, but not limited to, within the range of 0.5 inches to 36 inches in height from the airport runway surface 3.

EXAMPLE 6

Figure 9:
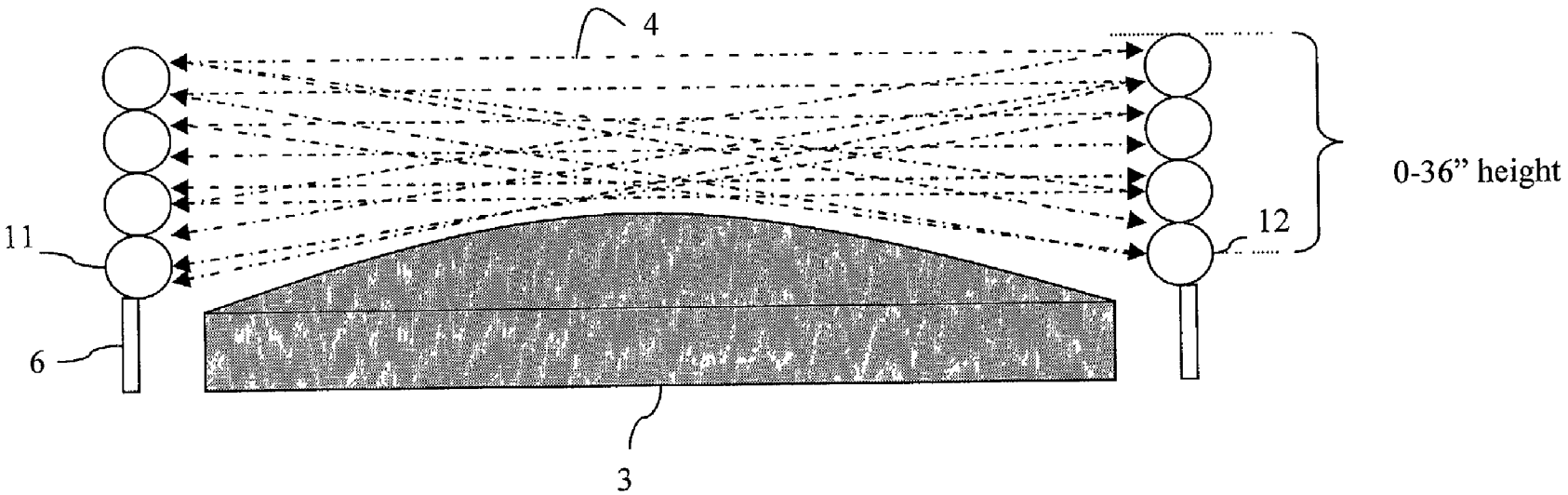
FIG. 9 is a front view of a convex airport runway surface with optical laser embodiments present on both sides showing a laser beam configuration covering the width of the area specified in both directions constantly traveling through several different planes.

FIG. 9 is a front view of a convex airport runway surface 3 with optical laser transceivers 11 located on one side of the supporting mechanism 6, opposite of the optical laser reflectors 12 located on the other side of runway surface 3, also located on supporting mechanism 6. The direction of the optical lasers 4 show the configuration covering the width of the area specified in both directions from left to right while constantly traveling through several different planes, for example, but not limited to, within the range of 0.5 inches to 36 inches in height from the airport runway surface 3.

EXAMPLE 7

Figure 10:
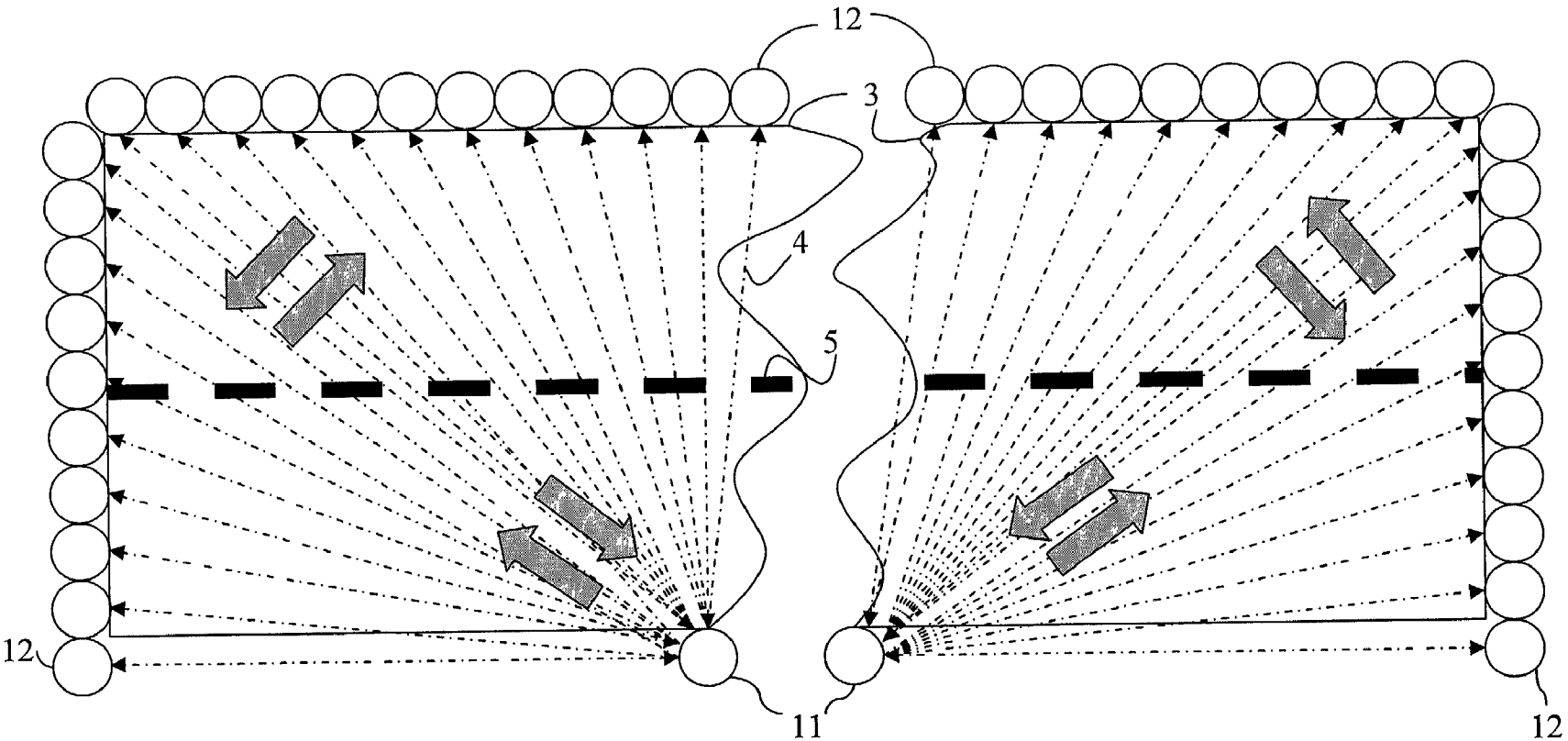
FIG. 10 is a top view of the entire airport runway surface with optical laser embodiments present on all sides showing the laser beam configuration covering both width and length of the area specified. Laser beams are, in four different constant directions, two of which are sweeping both left and right traveling through several different planes.

FIG. 10 is a top view of the entire airport runway surface 3, with optical laser transceivers 11 located on airport runway surface 3. Optical laser reflectors 12 are located across the airport runway surface 3 from the optical laser transceivers 11, as well as on both ends of the airport runway surface 3. The optical laser beam 4 configuration covers both the width and length of the airport runway surface 3. These optical laser beams 4 are in four different constant directions, two of which travel from the optical laser transceivers 11 to the optical laser reflectors 12 and return to the optical laser transceiver 11. Two of the other optical laser beams 4 are sweeping both left and right traveling through several different planes reflecting off of the optical laser reflectors 12 and returning to the optical laser transceivers 11. This configuration can either be set-up in sections down the entire airport runway surface 3 covering small sections, or can be configured in one big pattern to encompass the entire airport runway surface 3.

EXAMPLE 8

Figure 11:
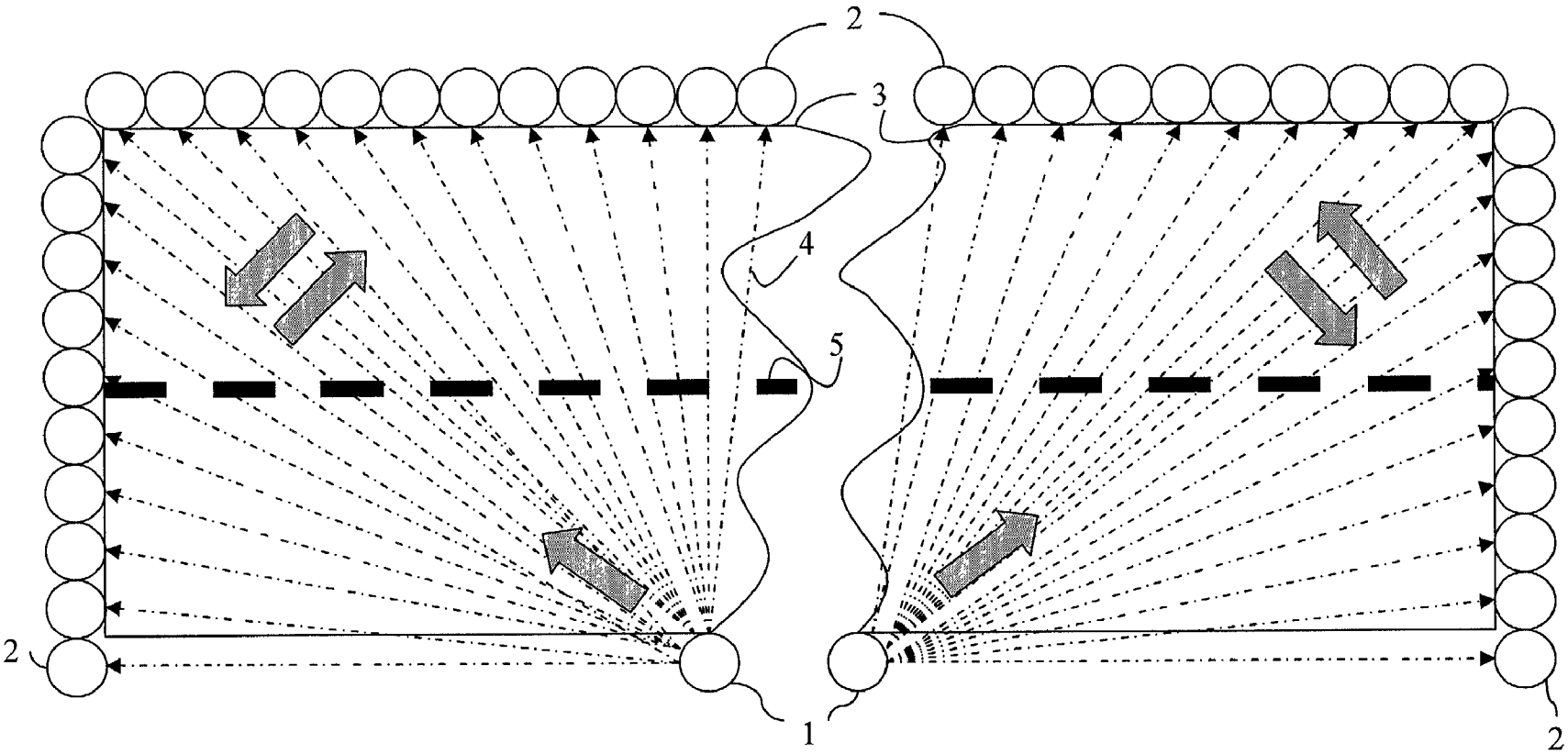
FIG. 11 is a top view of the airport runway surface with optical laser embodiments present on all sides showing the laser beam configuration covering in a constant direction both width and length of the area specified. Laser beam are in three different constant directions, two of which are sweeping both left and right traveling through several different planes.

FIG. 11 is a top view of the entire airport runway surface 3, with optical laser transmitters 1 located on the airport runway surface 3. Optical laser receivers 2 are located across the airport runway surface 3 from the optical laser transmitters 1, as well as on both ends of the airport runway surface 3. The optical laser beam 4 configuration covers both the width and length of the airport runway surface 3. These optical laser beams 4 are in three different constant directions, one of which travels from the optical laser transmitter 1 to the optical laser receiver 2, and two of which are sweeping both left and right traveling through several different planes. This configuration can either be set-up in sections down the entire airport runway surface 3 covering small sections, or can be configured in one big pattern to encompass the entire airport runway surface 3.

EXAMPLE 9

Figures 12, 12A:
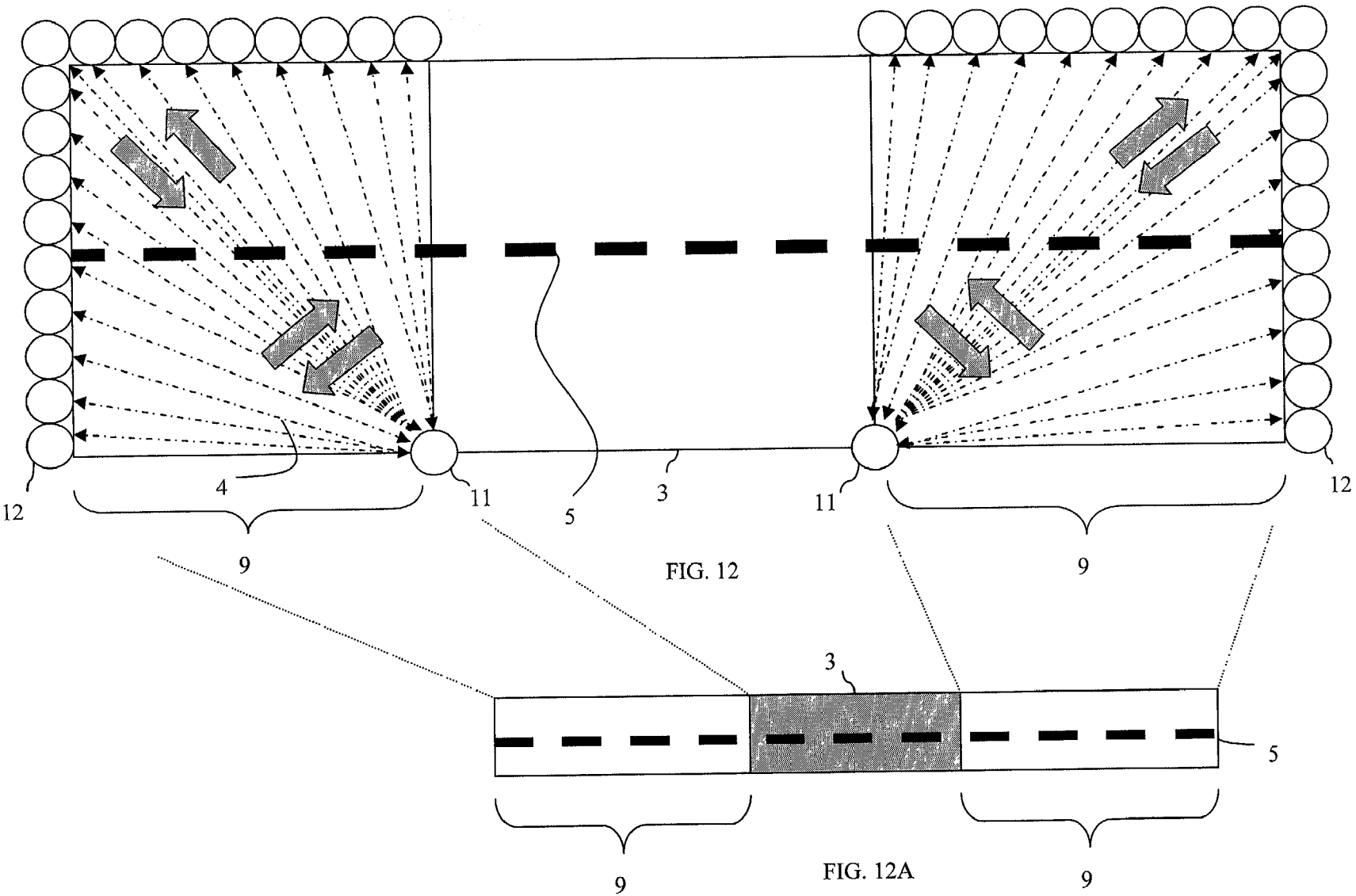
FIG. 12 is a top view of the airport runway surface with optical laser embodiments present at both ends of landing and take off portions of airport runway surface showing a laser beam configuration covering in a constant direction both width and length of the area specified. Laser beams are in four different constant directions, two of which are sweeping both left and right traveling through several different planes.
FIG. 12A is a simplified top view of the airport runway surface illustrating where optical lasers would provide protection for aircraft in landing and take off sections of the airport runway surface.

FIG. 12 is a top view of the entire airport runway surface 3, with optical laser transceivers 11 located at the end section of the airport runway surface 3. Optical laser reflectors 12 are located across the airport runway surface 3 from the optical laser transceivers 11, as well as on both ends of the airport runway surface 3. The optical laser beam 4 configuration covers both the width and length of the airport runway surface 3. These optical laser beams 4 are in four different constant directions, two of which travel from the optical laser transceivers 11 to the optical laser reflectors 12 and return to the optical laser transceivers 11. Two of the other optical laser beams 4 are sweeping both left and right traveling through several different planes. The configuration of this particular setup is located within the specific landing and take off sections 9 of the airport runway surface 3. FIG. 12A is a simplified top view of the airport runway surface 3 illustrating where optical laser beams 4 would provide protection for aircraft within landing and take off sections 9 of the airport runway surface 3.

EXAMPLE 10

Figure 13:
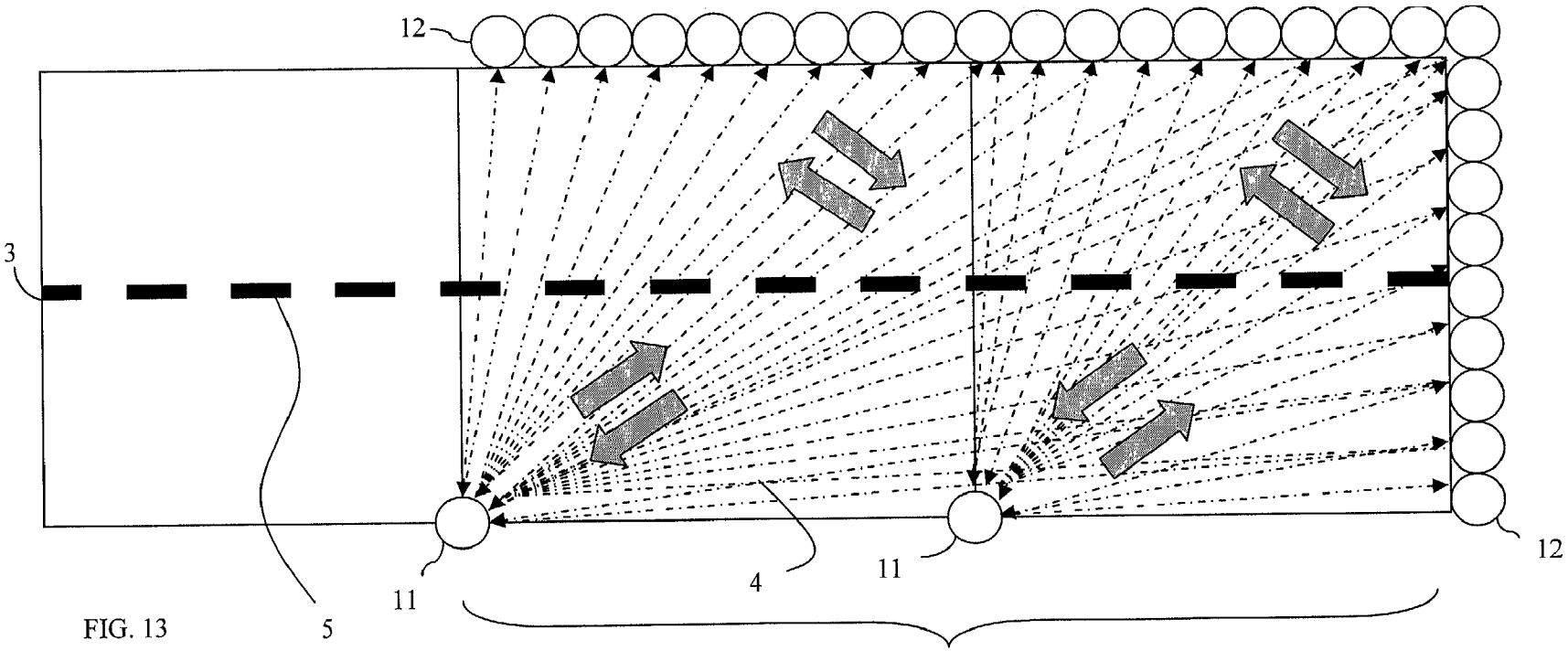
FIG. 13 is a top view of the airport runway surface with optical laser embodiments present along parameter showing a laser beam configuration covering length and width of the area specified in four different constant directions, two of which are sweeping both left and right traveling through several different planes.
Figure 13A:
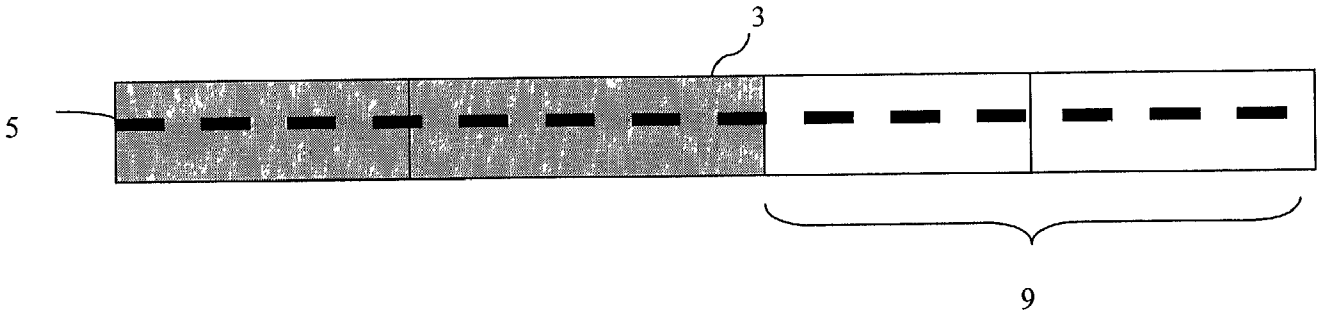
FIG. 13A is a simplified top view of the airport runway surface illustrating where an optical laser would provide protection for aircraft in landing and take off sections of the airport runway surface.

FIG. 13 is a top view of the entire airport runway surface 3, with optical laser transceivers 11 located at the end section of the airport runway surface 3. Optical laser reflectors 12 are located across the airport runway surface 3 from the optical laser transceivers 11, as well as on one end of the airport runway surface 3. The optical laser beam 4 configuration covers both the width and length of the airport runway surface 3. These optical laser beams 4 are in four different constant directions, two of which travel from the optical laser transceivers 11 to the optical laser reflectors 12 and return to the optical laser transceiver 11. Two of the other optical laser beams 4 are sweeping both left and right traveling through several different planes. The configuration of this particular setup is located within the specific landing and take off sections 9 of the airport runway surface 3. FIG. 13A is a simplified top view of the airport runway surface 3 illustrating where optical laser beams 4 would provide protection for aircraft within landing and take off sections 9 of the airport runway surface 3.

EXAMPLE 11

Figure 14:
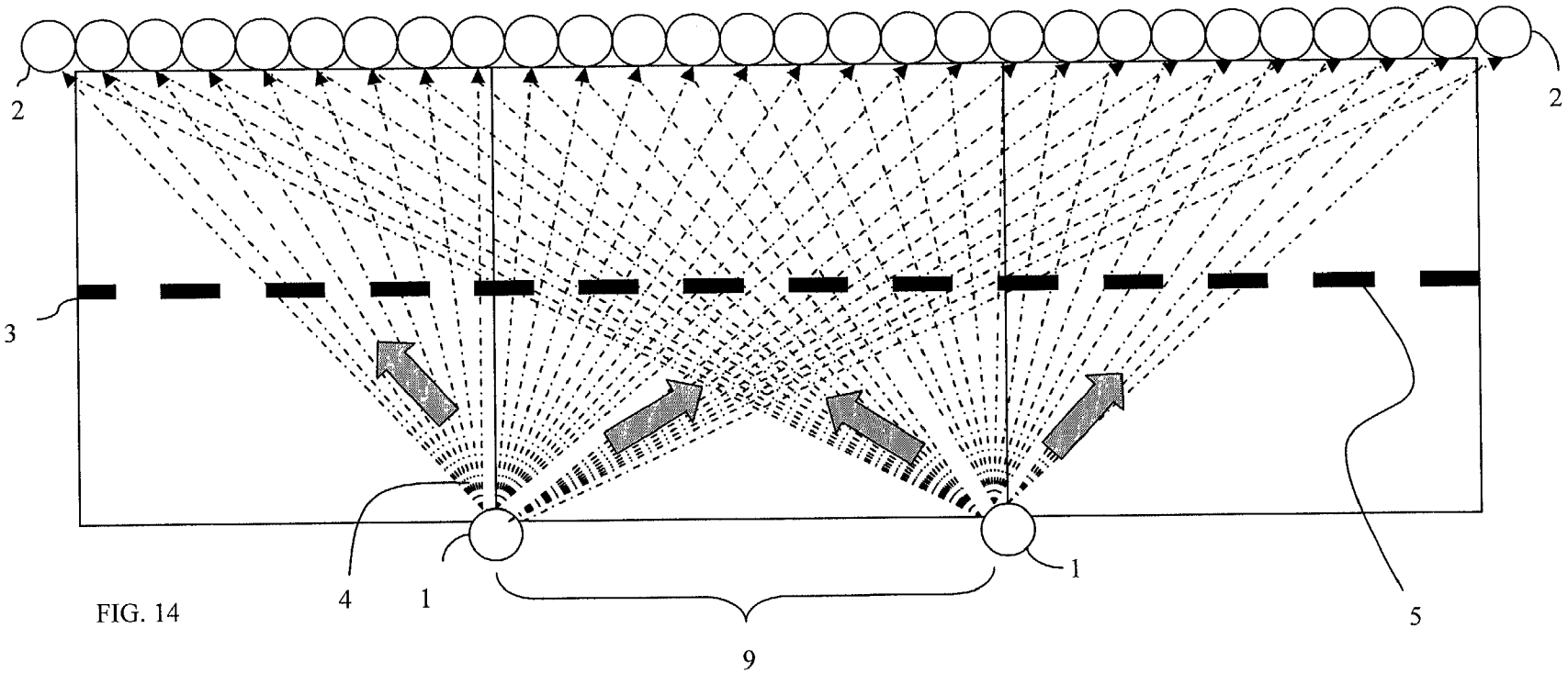
FIG. 14 is a top view of the airport runway surface with optical laser embodiments present on one side showing a laser beam configuration covering the width of area specified in two constant directions traveling through several different planes.
Figure 14A:
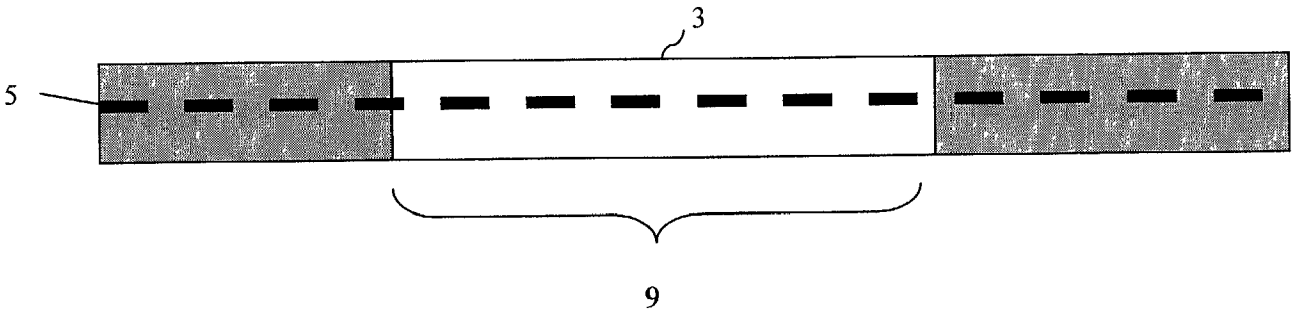
FIG. 14A is a simplified top view of the airport runway surface illustrating where optical laser would provide protection for aircraft in landing and take off sections of the airport runway surface.

FIG. 14 is a top view of the entire airport runway surface 3, with optical laser transmitters 1 located on the airport runway surface 3. Optical laser receivers 2 are located along the entire length of the airport runway surface 3 across from the optical laser transmitters 1. The optical laser beam 4 configuration covers both the width and length of the airport runway surface 3. The optical laser beams 4 are in one constant direction which travels from the optical laser transmitter 1 to the optical laser receiver 2 traveling through several different planes. This configuration can either be set-up in sections down the entire airport runway surface 3 covering small sections, or can be configured in one large pattern to encompass the entire airport runway surface 3. FIG. 14A is a simplified top view of the airport runway surface 3 illustrating where optical laser beams 4 would provide protection for aircraft within landing and take off sections 9 of the airport runway surface 3.

EXAMPLE 12

Figure 15:
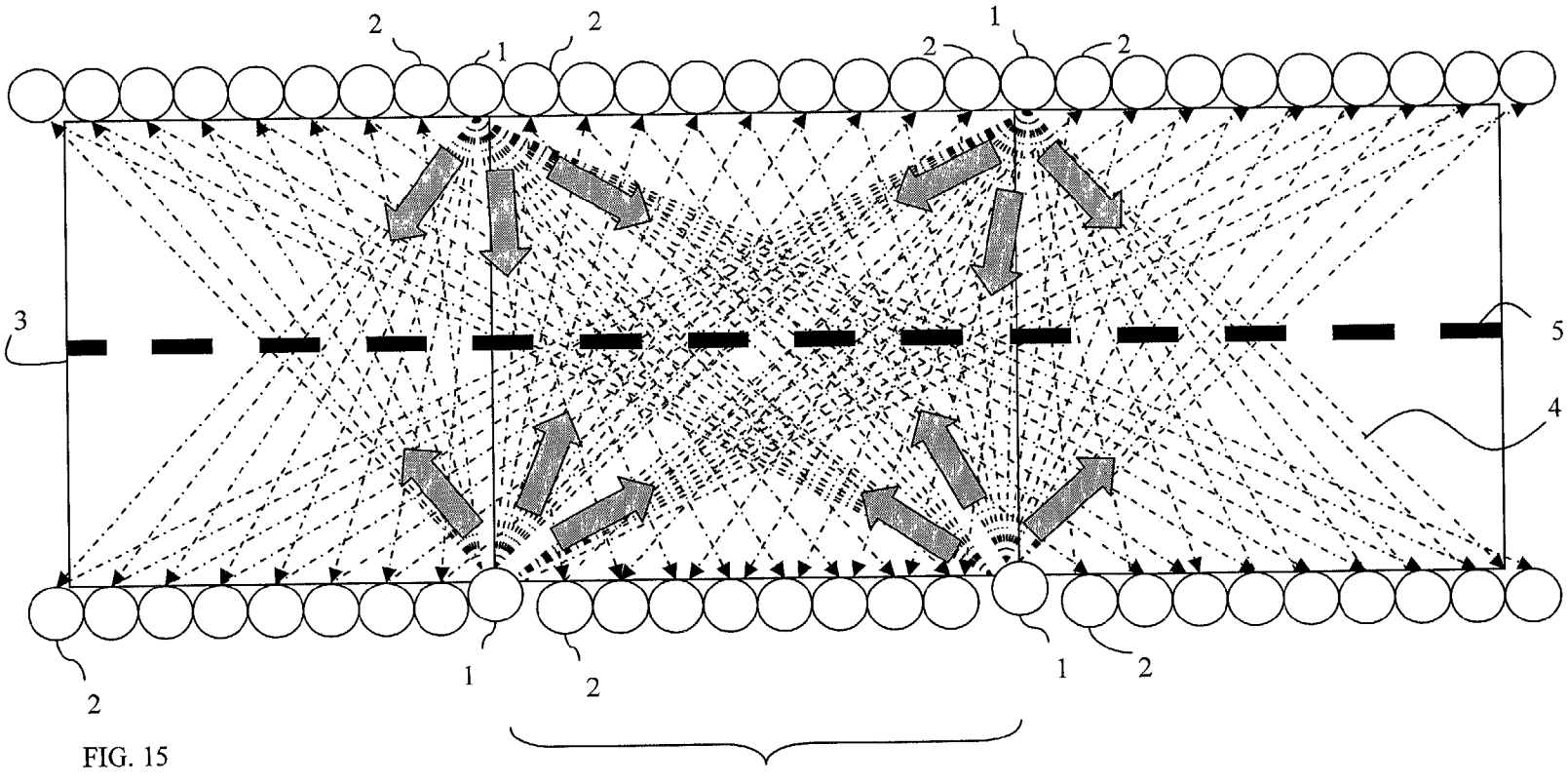
FIG. 15 is a top view of the airport runway surface with optical laser embodiments present on both sides showing a laser beam configuration covering the width of the area specified in three constant directions traveling through several different planes.
Figure 15A:
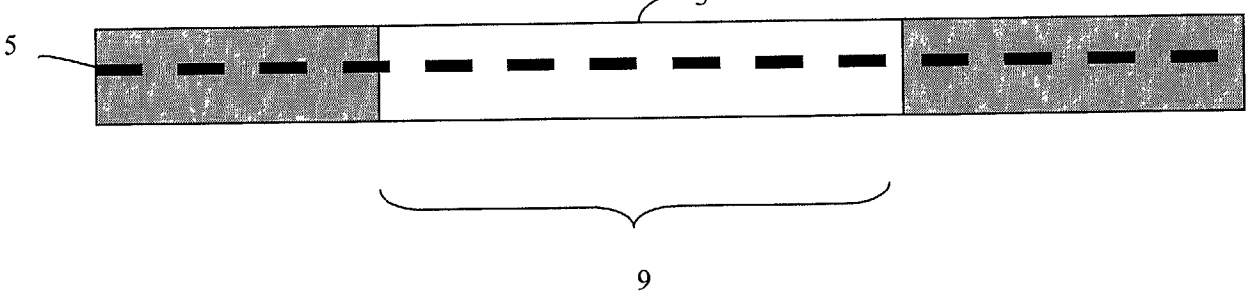
FIG. 15A is a simplified top view of the airport runway surface illustrating where optical laser would provide protection for aircraft in landing and take off sections of the airport runway surface.

FIG. 15 is a top view of the entire airport runway surface 3, with a total of four optical laser transmitters 1, two located across from each other respectively on the airport runway surface 3. Optical laser receivers 2 are located along the entire length of the airport runway surface 3 next to the optical laser transmitters 1. The optical laser beam 4 configuration covers both the width and length of the airport runway surface 3. The optical laser beams 4 are in one constant direction which travels from the optical laser transmitter 1 to the optical laser receiver 2 traveling through several different planes. This configuration can either be set-up in sections down the entire airport runway surface 3 covering small sections, or can be configured in one large pattern to encompass the entire airport runway surface 3. FIG. 15A is a simplified top view of the airport runway surface 3 illustrating where optical laser beams 4 would provide protection for aircraft within landing and take off sections 9 of the airport runway surface 3.

EXAMPLE 13

Figure 16:
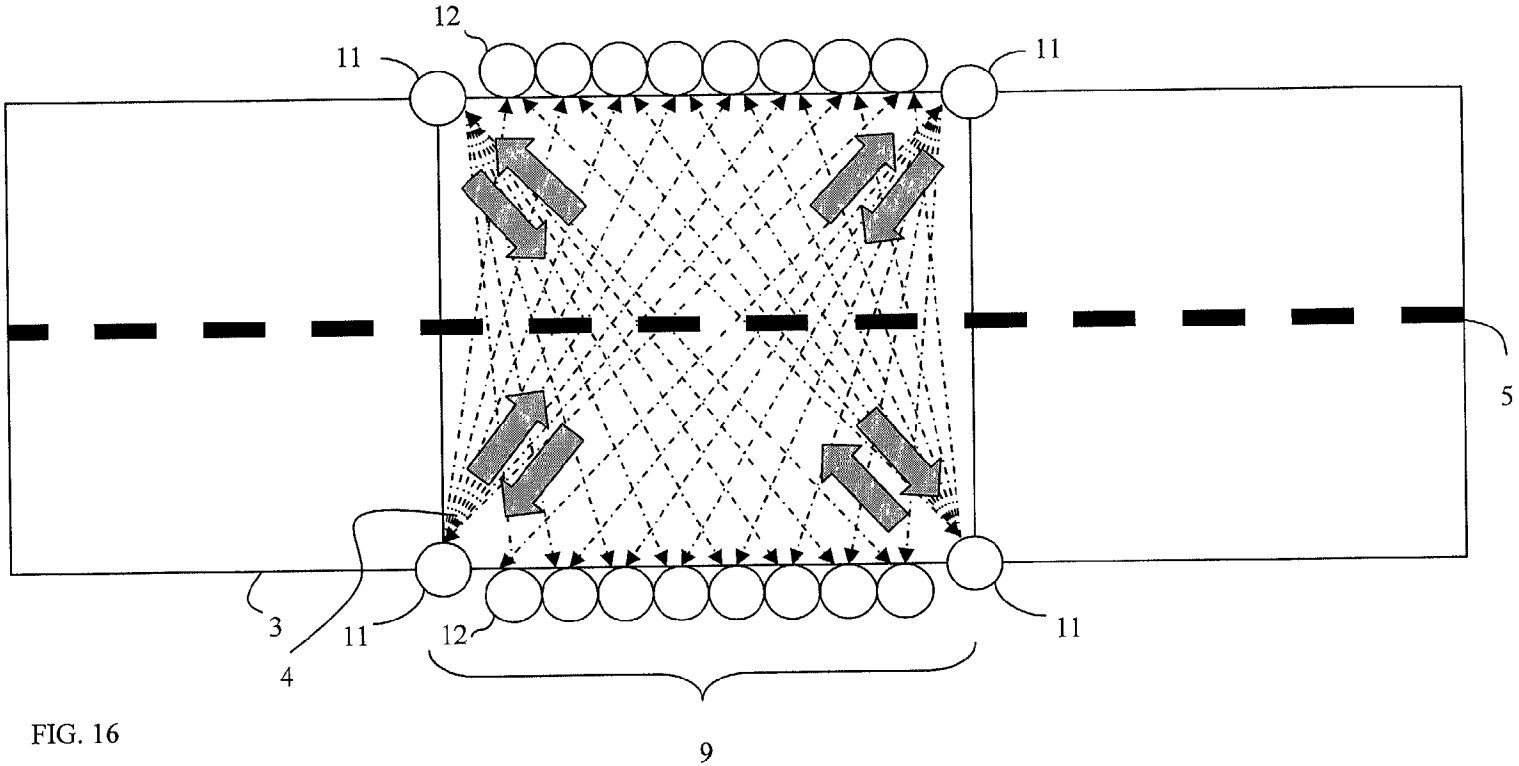
FIG. 16 is a top view of the airport runway surface with optical laser embodiments present on all four sides showing laser beam configuration covering both length and width of the area specified in two constant directions traveling through several different planes.
Figure 16A:
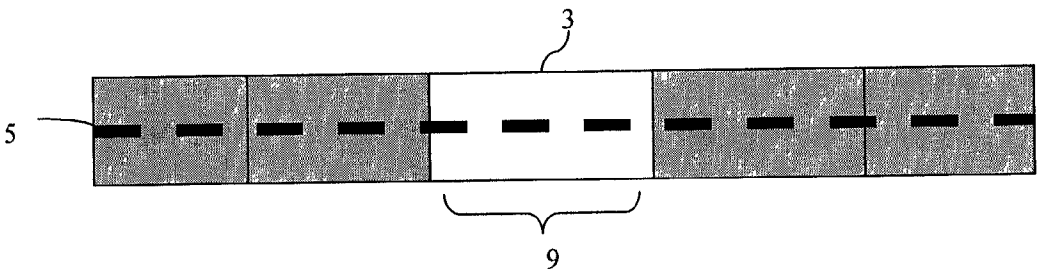
FIG. 16A is a simplified top view of the airport runway surface illustrating where optical laser would provide protection for aircraft in landing and take off sections of the airport runway surface.

FIG. 16 is a top view of the entire airport runway surface 3, with four optical laser transceivers 11, each located at one corner of a square section of the airport runway surface 3. Optical laser reflectors 12 are located across the airport runway surface 3 from each other, able to reflect optical laser beams 4 over the width of the airport runway surface 3. The optical laser beam 4 configuration covers the width of the airport runway surface 3. These optical laser beams 4 are in two different constant directions of which travel from the optical laser transceivers 11 to the optical laser reflectors 12 and return to the optical laser transceivers 11 while traveling through several different planes. The configuration of this particular setup may be located within the specific landing and take off sections 9 of the airport runway surface 3. This configuration can either be set-up in sections down the entire airport runway surface 3 covering small sections, or can be configured in one large pattern to encompass the entire airport runway surface 3. FIG. 16A is a simplified top view of the airport runway surface 3 illustrating where optical laser beams 4 would provide protection for aircraft within landing and take off sections 9 of the airport runway surface 3.

EXAMPLE 14

Figure 17:
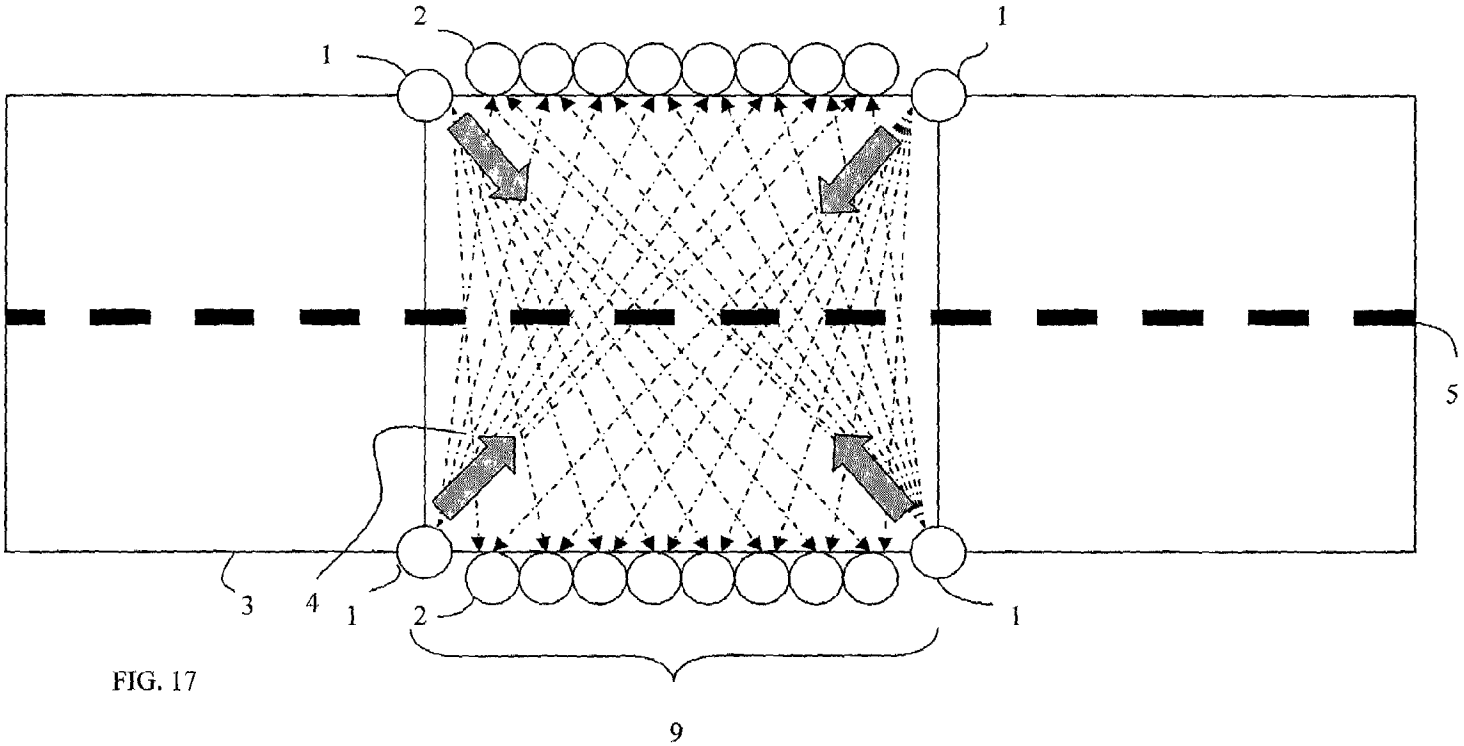
FIG. 17 is a top view of the airport runway surface with optical laser embodiments present on all four sides showing laser beam configuration covering both length and width of the area in one constant direction traveling through several different planes.
Figure 17A:
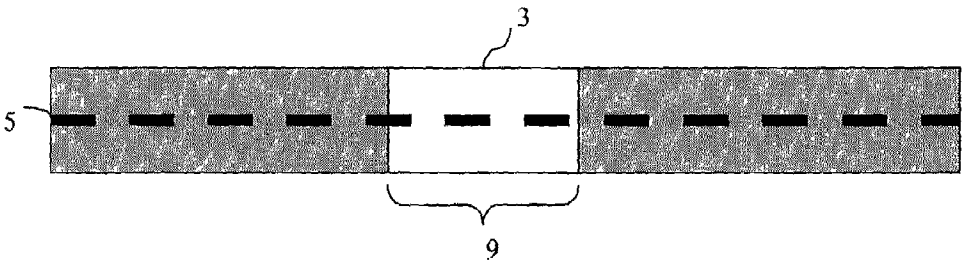
FIG. 17A is a simplified top view of the airport runway surface illustrating where optical laser would provide protection for aircraft in landing and take off sections of the airport runway surface.

FIG. 17 is a top view of the entire airport runway surface 3, with four optical laser transmitters 1 each located at one corner of a square section of the airport runway surface 3. Optical laser receivers 2 are located across the airport runway surface 3 from each other, able to receive optical laser beams 4 over the width of the airport runway surface 3. The optical laser beam 4 configuration covers the width of the airport runway surface 3. These optical laser beams 4 are in one constant direction of which travels from the optical laser transmitters 1 to the optical laser receivers 2 while traveling through several different planes. The configuration of this particular setup may be located within the specific landing and take off sections 9 of the airport runway surface 3. This configuration can either be set-up in sections down the entire airport runway surface 3 covering small sections, or can be configured in one large pattern to encompass the entire airport runway surface 3. FIG. 17A is a simplified top view of the airport runway surface 3 illustrating where optical laser beams 4 would provide protection for aircraft within landing and take off sections 9 of the airport runway surface 3.

EXAMPLE 15

Figures 18, 18A:
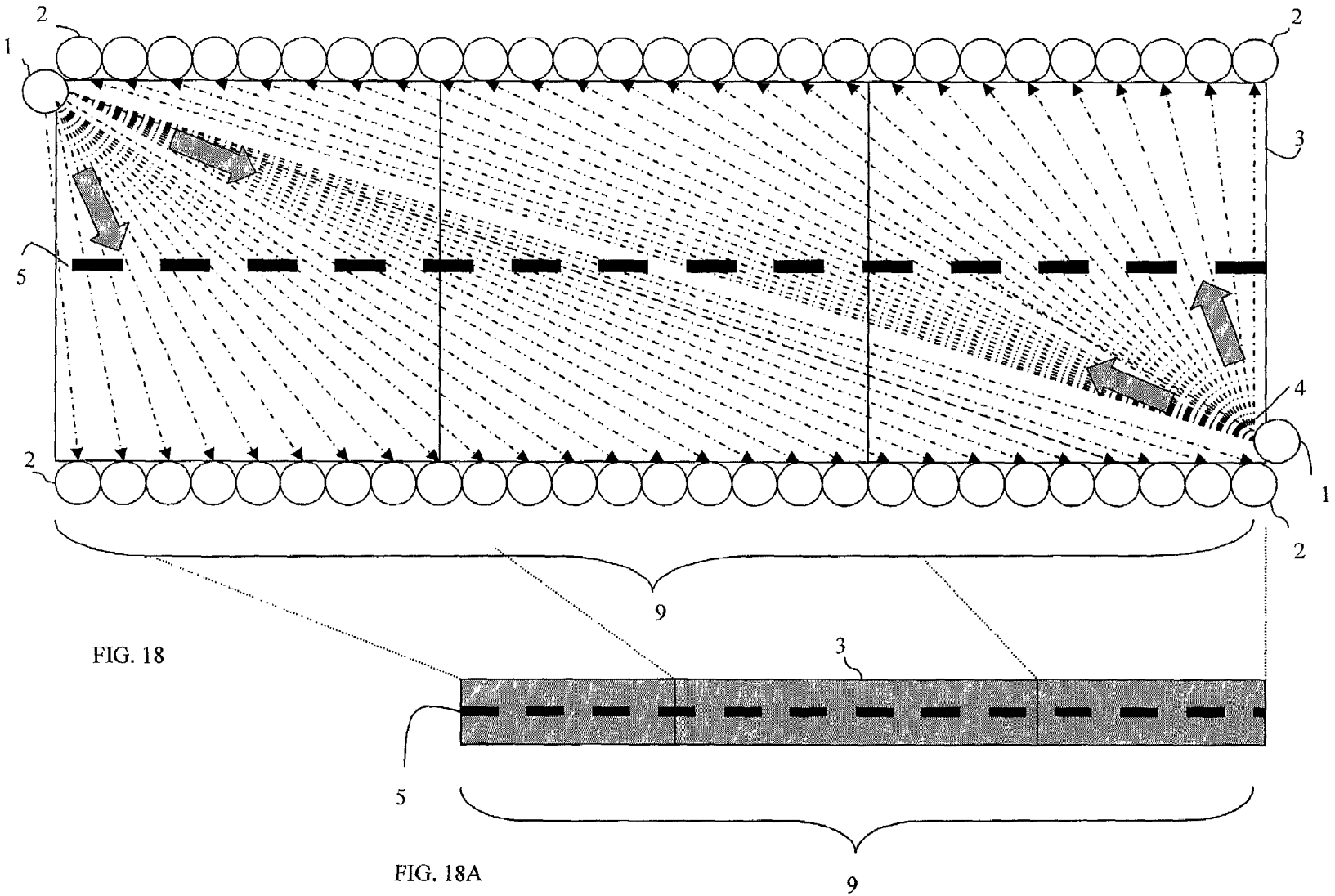
FIG. 18 is a top view of the airport runway surface with optical laser embodiments present at both ends of the airport runway surface showing laser beam configuration covering the length and width of specified areas in one direction constantly traveling through several different planes.
FIG. 18A is a simplified top view of the airport runway surface illustrating where optical laser would provide protection for aircraft in landing and take off sections of the airport runway surface.

FIG. 18 is a top view of the entire airport runway surface 3, with a total of two optical laser transmitters 1, located diagonally across from each other respectively at the end of the airport runway surface 3 in opposite corners. Optical laser receivers 2 are located along the entire length of the airport runway surface 3 next to the optical laser transmitters 1. The optical laser beam 4 configuration covers both the width and length of the airport runway surface 3. The optical laser beams 4 are in one constant direction which travels from the optical laser transmitter 1 to the optical laser receiver 2 traveling through several different planes. This configuration can either be set-up in sections down the entire airport runway surface 3 covering small sections, or can be configured in one large pattern to encompass the entire airport runway surface 3. FIG. 18A is a simplified top view of the airport runway surface 3 illustrating where optical laser beams 4 would provide protection for aircraft within landing and take off sections 9 of the airport runway surface 3.

EXAMPLE 16

Figures 19, 19A:
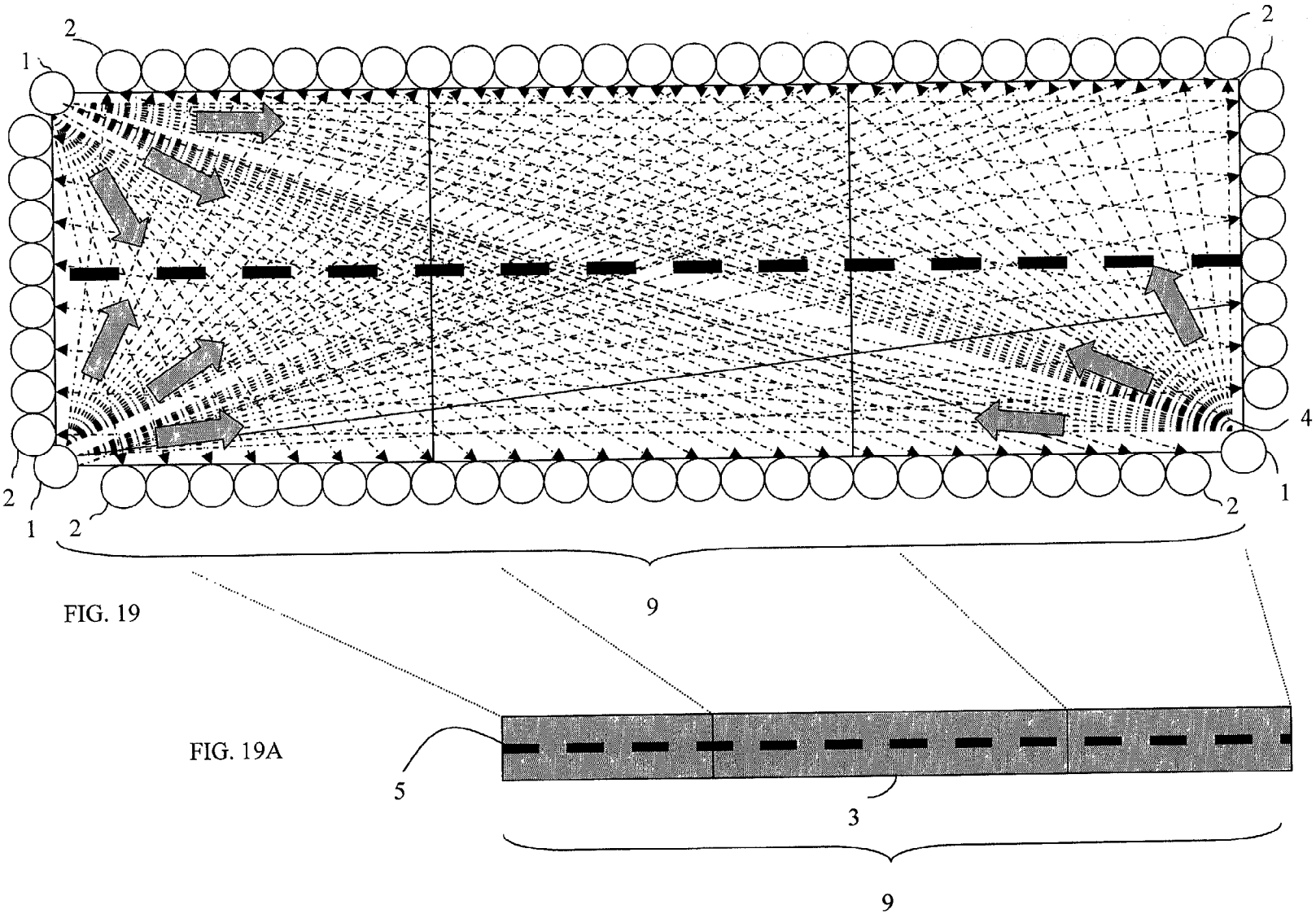
FIG. 19 is a top view of the airport runway surface with optical laser embodiments present at both ends of the airport runway surface showing laser beam configuration covering the length and width of a specified area from three different directions constantly traveling through several different planes.
FIG. 19A is a simplified top view of the airport runway surface illustrating where an optical laser would provide protection for aircraft in landing and take off sections of the airport runway surface.

FIG. 19 is a top view of the entire airport runway surface 3, with a total of three optical laser transmitters 1, two of which are located diagonally across from each other respectively at the end of the airport runway surface 3 in opposite corners. The third optical laser transmitter 1 is located directly across from one of the optical laser transmitters 1 located at one end of the airport runway surface 3. Optical laser receivers 2 are located along the entire length of the airport runway surface 3, and at both ends of the airport runway surface 3. With this configuration the optical laser beam 4 covers both the width and length of the airport runway surface 3. The optical laser beams 4 are in one constant direction which travels from the optical laser transmitter 1 to the optical laser receiver 2 traveling through several different planes. This configuration can either be set-up in sections down the entire airport runway surface 3 covering small sections, or can be configured in one big pattern to encompass the entire airport runway surface 3. FIG. 19A is a simplified top view of the airport runway surface 3 illustrating where optical laser beams 4 would provide protection for aircraft within landing and take off sections 9 of the airport runway surface 3.

EXAMPLE 17

Figure 20:
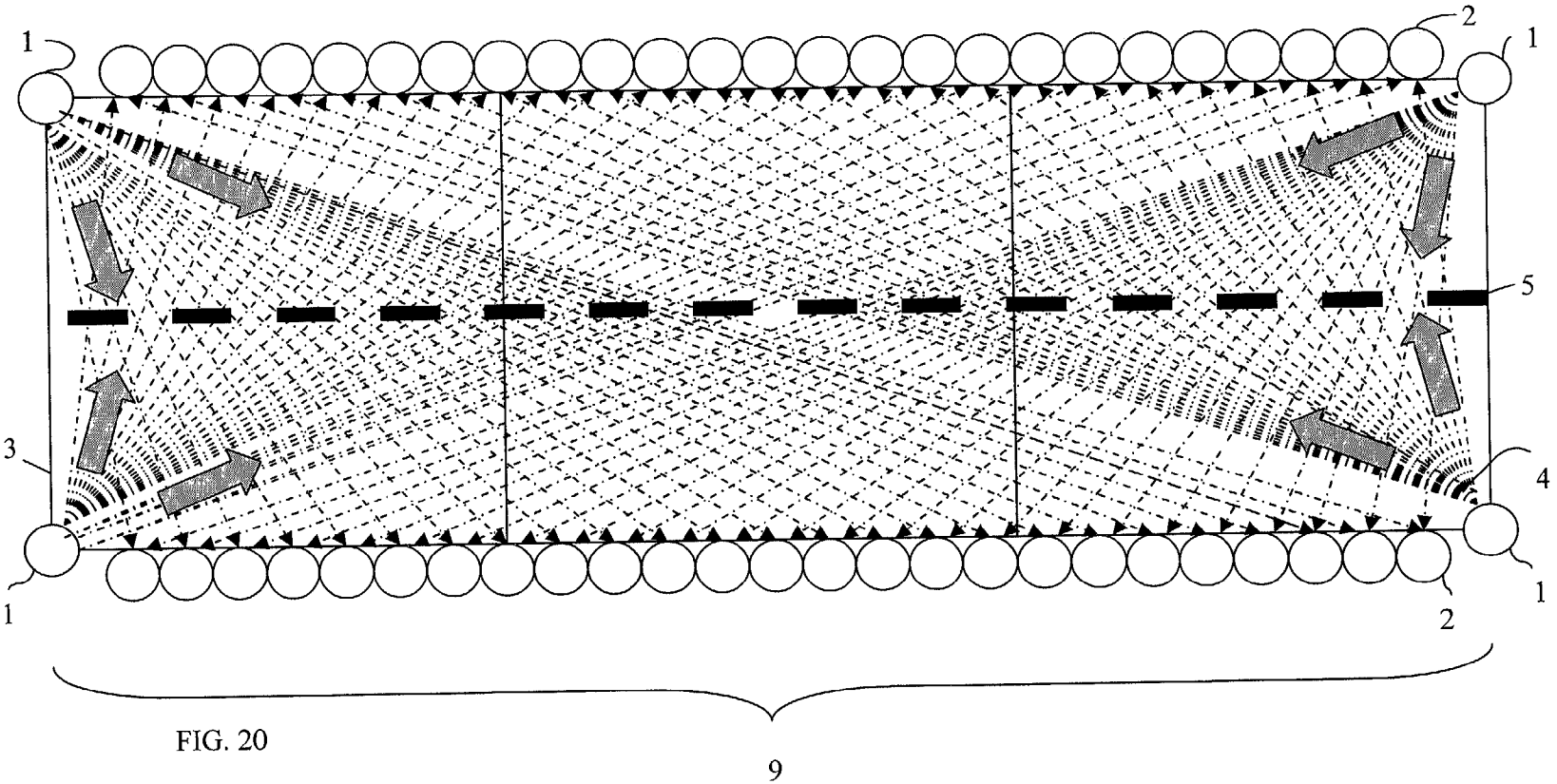
FIG. 20 is a top view of the airport runway surface with optical laser embodiments present at all four corners of the airport runway surface showing laser beam configuration covering the length and width of specified area from four different directions constantly traveling through several different planes.
Figure 20A:
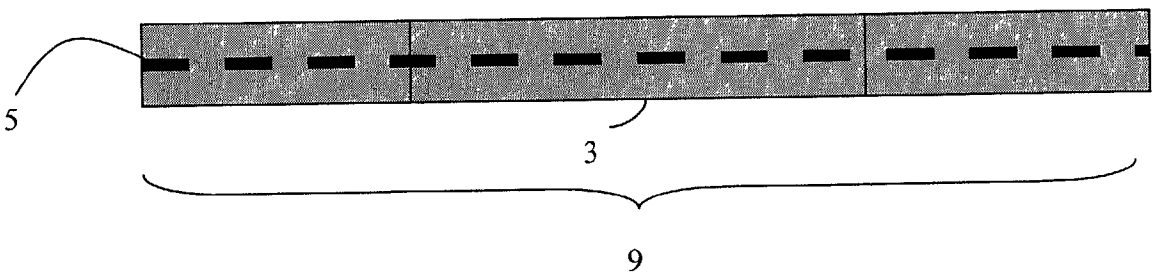
FIG. 20A is a simplified top view of the airport runway surface illustrating where optical laser would provide protection for aircraft in landing and take off sections of the airport runway surface.

FIG. 20 is a top view of the entire airport runway surface 3, with a total of four optical laser transmitters 1, one of which is located at each corner of the airport runway surface 3. Optical laser receivers 2 are located along the entire length of the airport runway surface 3. With this configuration the optical laser beam 4 covers both the width and length of the airport runway surface 3. The optical laser beams 4 are in one constant direction which travel from the optical laser transmitters 1 to the optical laser receivers 2 traveling through several different planes. This configuration can either be set-up in sections down the entire airport runway surface 3 covering small sections, or can be configured in one large pattern to encompass the entire airport runway surface 3. FIG. 20A is a simplified top view of the airport runway surface 3 illustrating where optical laser beams 4 would provide protection for aircraft within landing and take off sections 9 of the airport runway surface 3.

EXAMPLE 18

Figure 21:
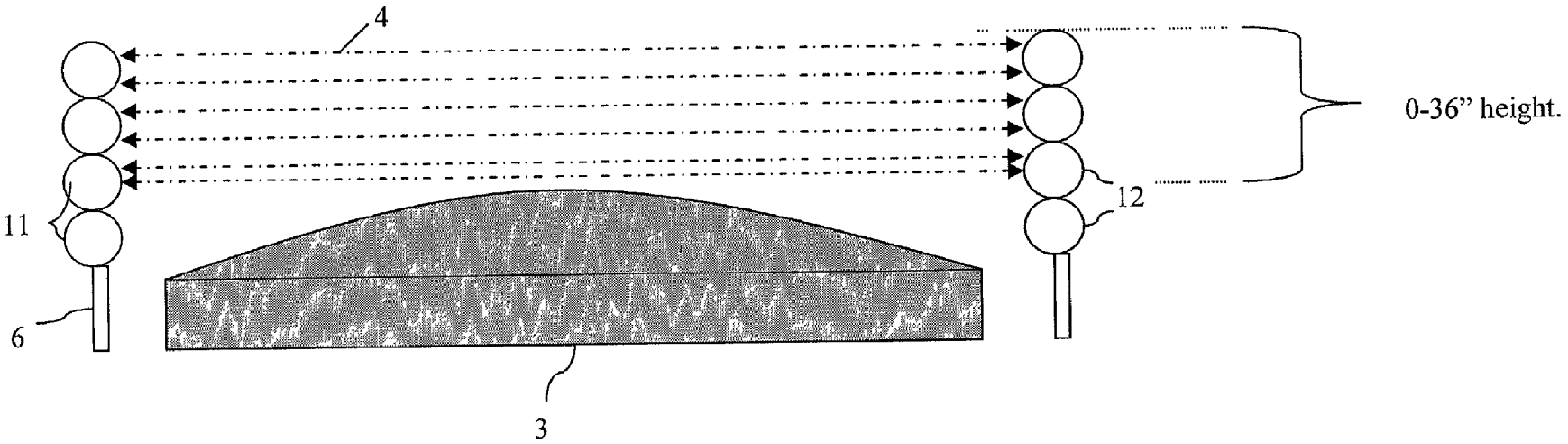
FIG. 21 is a front view of a convex airport runway surface with optical laser embodiments present on both sides showing laser beam configuration covering the width of the area specified in both directions constantly traveling through one plane.

FIG. 21 is a front view of a convex airport runway surface 3 with optical transceivers 11 located on one side of the airport runway surface 3 across from optical laser reflectors 12 located on the other side of the airport runway surface 3. The optical laser beams 4 traveling from the optical laser transceivers 11 to the optical laser reflectors 12 and returning back to the optical laser transceivers 11 are configured to cover the width of the area specified in both directions constantly traveling through one plane, for example, but not limited to, within the range of 0.5 inches to 36 inches in height from the airport runway surface 3. This configuration can either be set-up in sections down the entire airport runway surface 3 covering small sections, or can be configured in one big pattern to encompass the entire airport runway surface 3.

EXAMPLE 19

Figure 22:
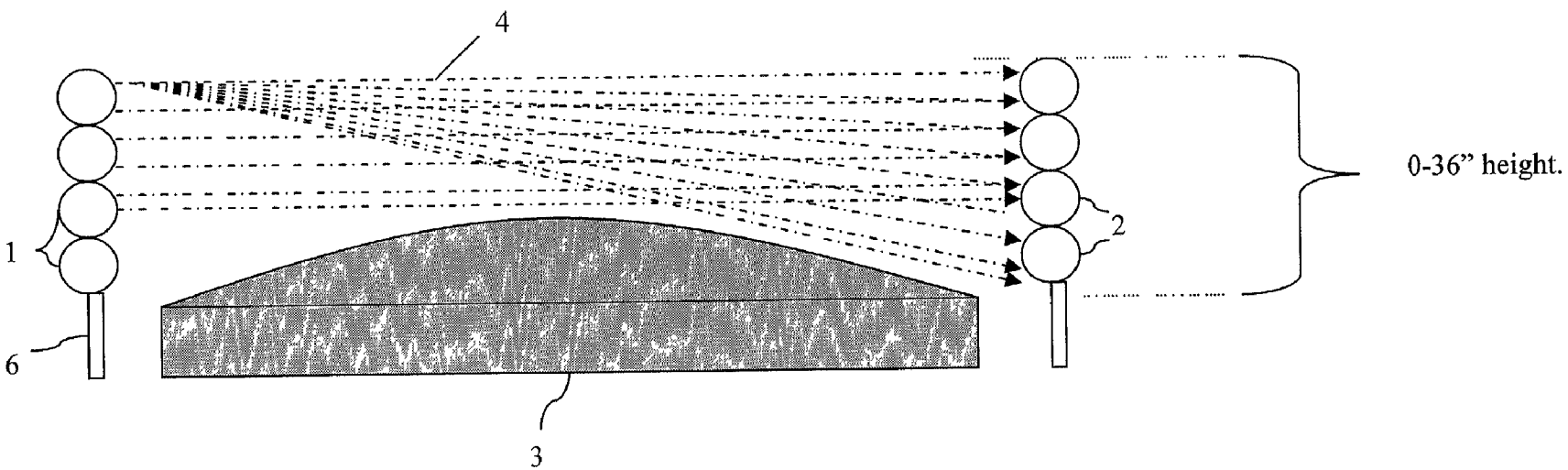
FIG. 22 is a front view of a convex airport runway surface with optical laser embodiments present on both sides showing laser beam configuration covering the width of the area specified in one direction constantly traveling through several different planes from left to right.

FIG. 22 is a front view of a convex airport runway surface 3 with optical transmitters 1 located on one side of the airport runway surface 3 across from optical laser receivers 2 located on the opposite side of the airport runway surface 3. The optical laser beams 4 traveling from the optical laser transmitters 1 to the optical laser receivers 2 are configured to cover the width of the area specified in one direction constantly traveling through several different planes, for example, but not limited to, within the range of 0.50 inches to 36 inches in height from the airport runway surface 3. This configuration can either be set-up in sections down the entire airport runway surface 3 covering small sections, or can be configured in one big pattern to encompass the entire airport runway surface 3.

EXAMPLE 20

Figure 23:
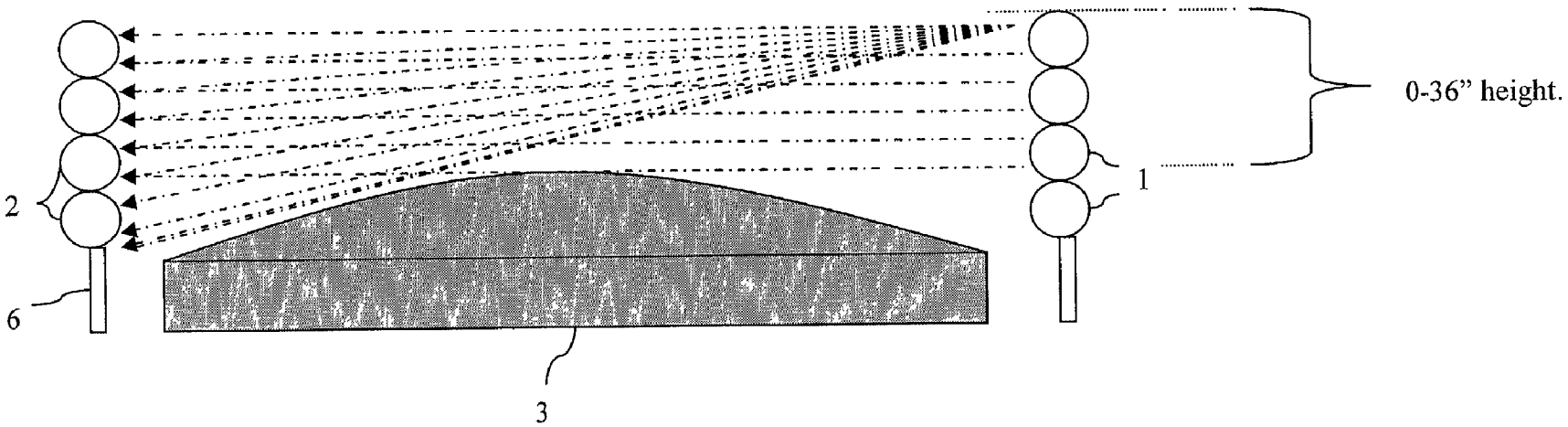
FIG. 23 is a front view of a convex airport runway surface with optical laser embodiments present on both sides showing laser beam configuration covering the width of the area specified in one direction constantly traveling through several different planes from right to left.

FIG. 23 is a front view of a convex airport runway surface 3 with optical transmitters 1 located on one side of the airport runway surface 3 across from optical laser receivers 2 located on the opposite side of the airport runway surface 3. The optical laser beams 4 traveling from the optical laser transmitters 1 to the optical laser receivers 2 are configured to cover the width of the area specified in one direction constantly traveling through several different planes, for example, but not limited to, within the range of 0.5 inches to 36 inches in height from the airport runway surface 3. This configuration can either be set-up in sections down the entire airport runway surface 3 covering small sections, or can be configured in one big pattern to encompass the entire airport runway surface 3.

EXAMPLE 21

Figure 24:
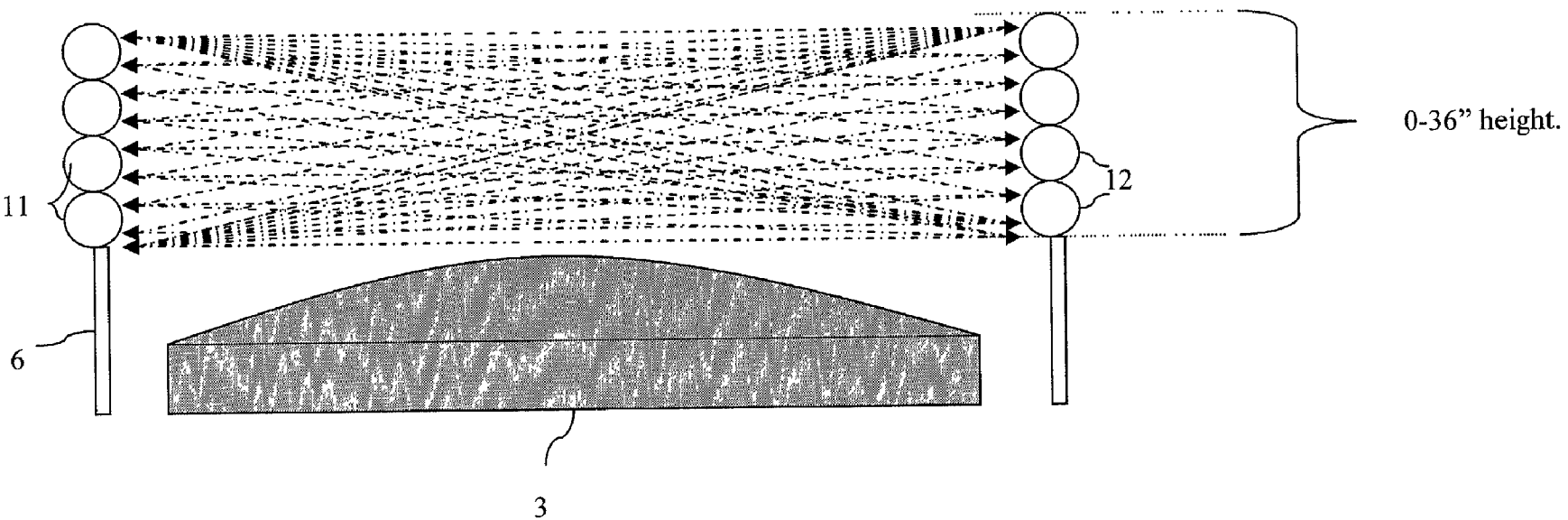
FIG. 24 is a front view of a convex airport runway surface with optical laser embodiments present on both sides showing laser beam configuration covering the width of the area specified in both directions constantly traveling through several different planes.

FIG. 24 is a front view of a convex airport runway surface 3 with optical transceivers 11 located on one side of the airport runway surface 3 across from optical laser reflectors 12 located on the opposite side of the airport runway surface 3. The optical laser beams 4 traveling from the optical laser transceivers 11 to the optical laser reflectors 12 are configured to cover the width of the area specified in both directions constantly traveling through several different planes, for example, but not limited to, within the range of 0.5 inches to 36 inches in height from the airport runway surface 3. This configuration can either be set-up in sections down the entire airport runway surface 3 covering small sections, or can be configured in one large pattern to encompass the entire airport runway surface 3.

EXAMPLE 22

Figure 25:
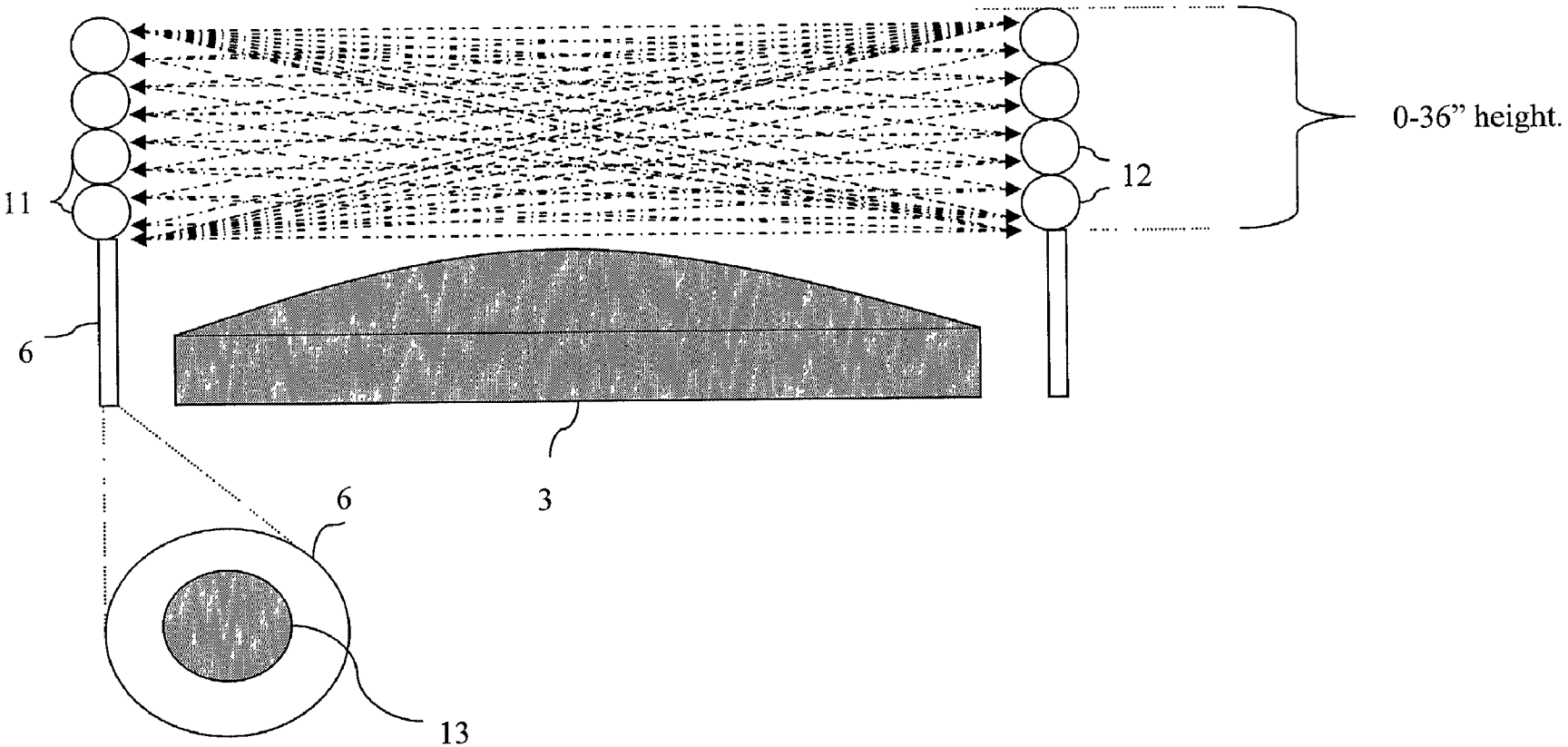
FIG. 25 is a front view of a convex airport runway surface, specifically showing a sectional view of the support for holding the optical laser embodiment located at the width of the airport runway surface. Illustrating that the inner core would maintain a constant temperature during inclement weather to prevent the freezing of all embodiments.

FIG. 25 is a front view of a convex airport runway surface 3, specifically showing a sectional view of the supporting mechanism 6 for holding the optical laser transmitter 1, optical laser receiver 2, optical laser transceiver 11, and the optical laser reflector 12. The inner core of the supporting mechanism 6 can have a heating element 13 located in or on the supporting mechanism 6 in order to maintain a constant temperature during inclement weather to prevent freezing of all optical laser system embodiments or the support mechanism.

EXAMPLE 23

Figure 26:
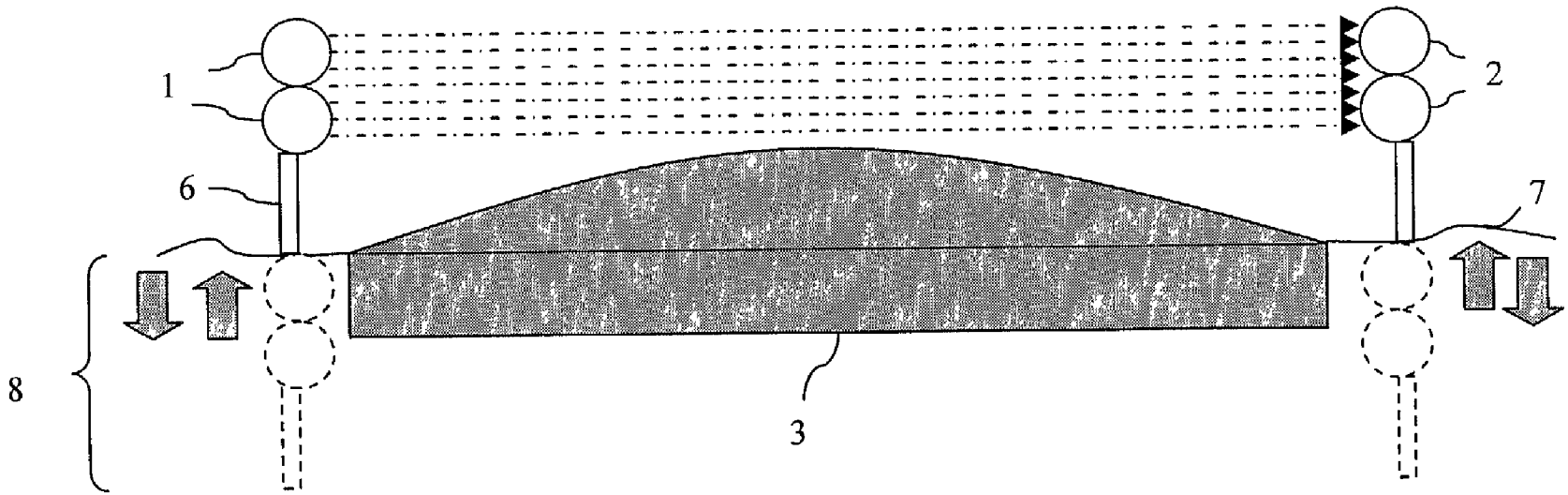
FIG. 26 is a front view of a convex airport runway surface, specifically showing the movement of raising and lowering the entire support for holding the optical laser embodiment located at the width of the airport runway surface.

FIG. 26 is a front view of a convex airport runway surface 3, specifically showing the adjusting means 8 for the raising and lowering of supporting mechanism 6. The entire supporting mechanism 6 for holding the optical laser transmitter 1, optical laser receiver 2, optical laser transceiver 11, and the optical laser reflector 12 located at the width of the airport runway surface 3 would travel above and below ground 7. The above and below ground location of embodiments are in order to prevent the apparatus from becomein an obstacle during the removal of snow and ice from the airport runway surface 3.

EXAMPLE 24

Figure 27:
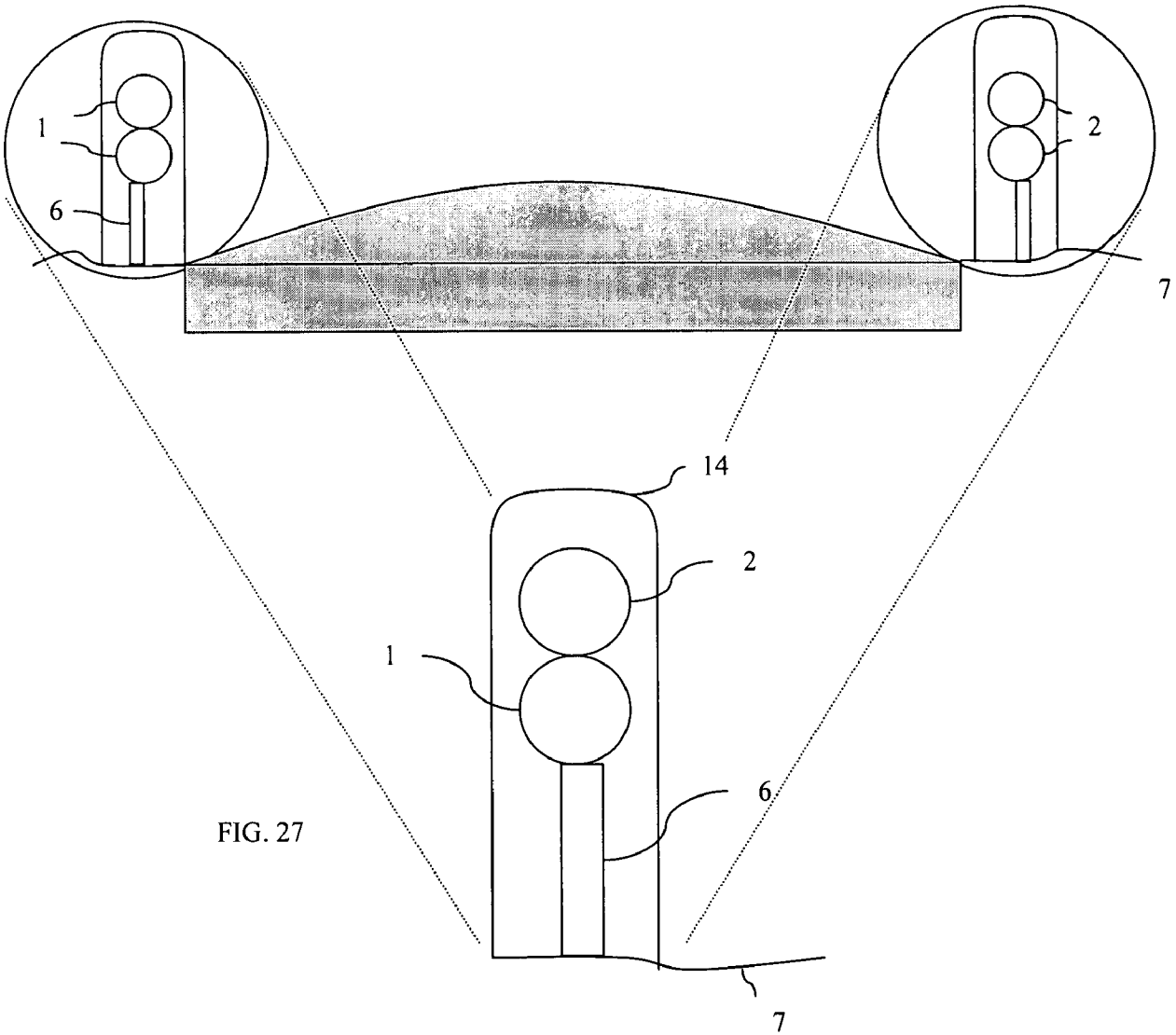
FIG. 27 is a detailed description of the clear covering that provides protection during inclement weather for the optical laser embodiment in order to ensure consistent results not having weather be a factor for reliability.

FIG. 27 is an illustration of a clear protective covering 14 that provides protection during inclement weather for the entire supporting mechanism 6, the optical laser transmitter 1, optical laser receiver 2, optical laser transceiver 11, and the optical laser reflector 12, located at the width of the airport runway surface 3.

EXAMPLE 25

Figure 28:
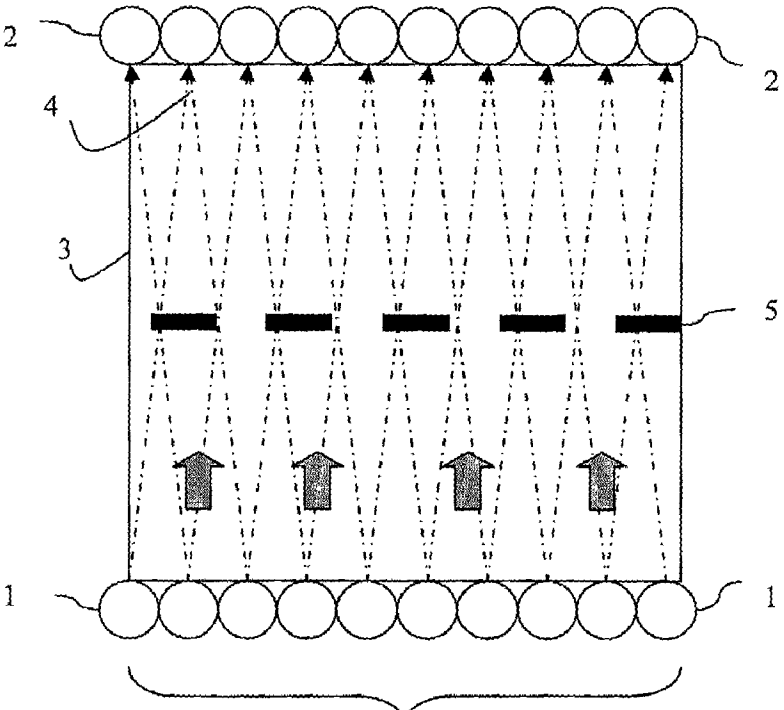
FIG. 28 is a top view of the airport runway surface with optical laser embodiment present on both sides of the width showing a constant laser beam configuration covering the width of the area specified in one direction constantly traveling through several different planes.
Figure 28A:
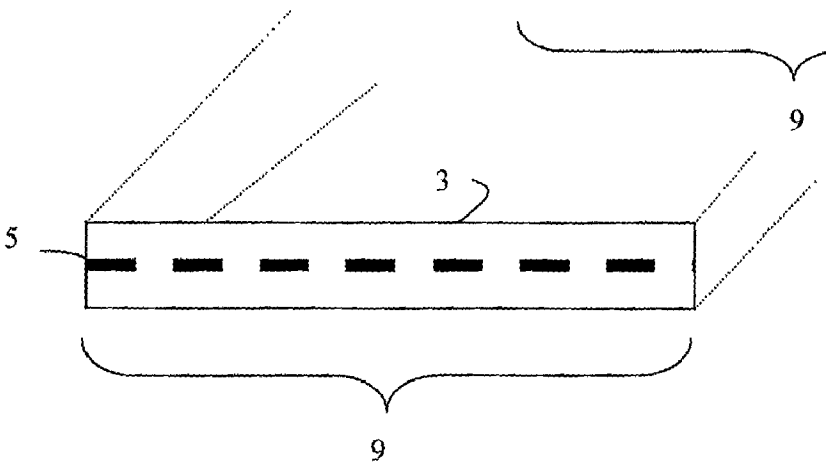
FIG. 28A is a simplified top view of the airport runway surface illustrating where optical laser would provide protection for aircraft in landing and take off sections of the airport runway surface.

FIG. 28 is a top view of the entire airport runway surface 3, with an equal number of optical laser transmitters 1, located on the opposite side of the same number of optical laser receivers 2 located across the width of the airport runway surface 3. Optical laser receivers 2 are located along the entire length of the airport runway surface 3 opposite of the optical laser transmitters 1. The optical laser beam 4 configuration covers both the width and length of the airport runway surface 3. The optical laser beams 4 are in one constant direction which travels from the optical laser transmitter 1 to the optical laser receiver 2 traveling through several different planes. This configuration can either be set-up in sections down the entire airport runway surface 3 covering small sections, or can be configured in one large pattern to encompass the entire airport runway surface 3. FIG. 28A is a simplified top view of the airport runway surface 3 illustrating where optical laser beams 4 would provide protection for aircraft within landing and take off sections 9 of the airport runway surface 3.

EXAMPLE 26

Figure 29:
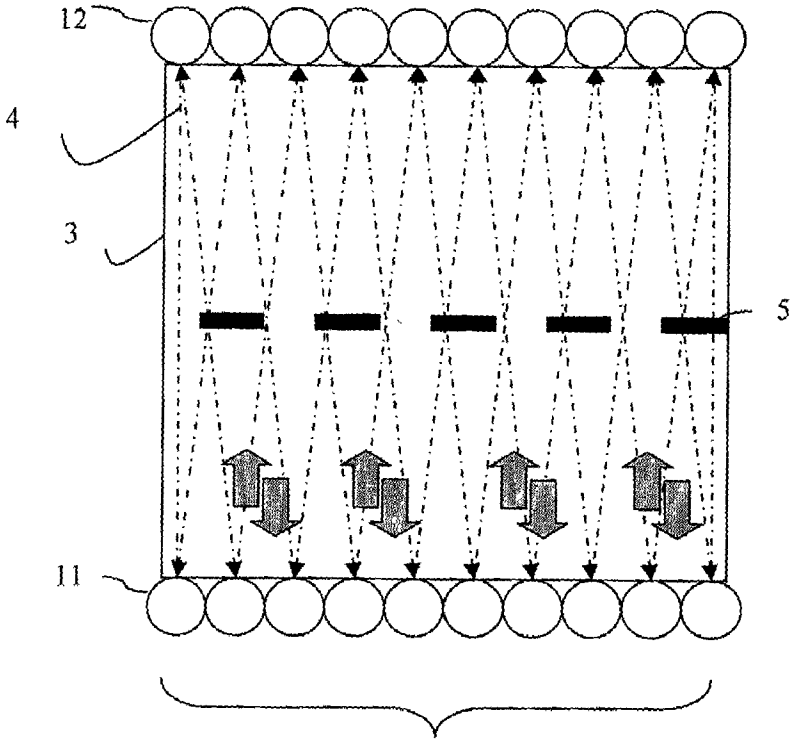
FIG. 29 is a top view of the airport runway surface with optical laser embodiments present on both sides of the width showing a laser beam configuration covering width of area specified in two directions constantly traveling through several different planes.
Figure 29A:
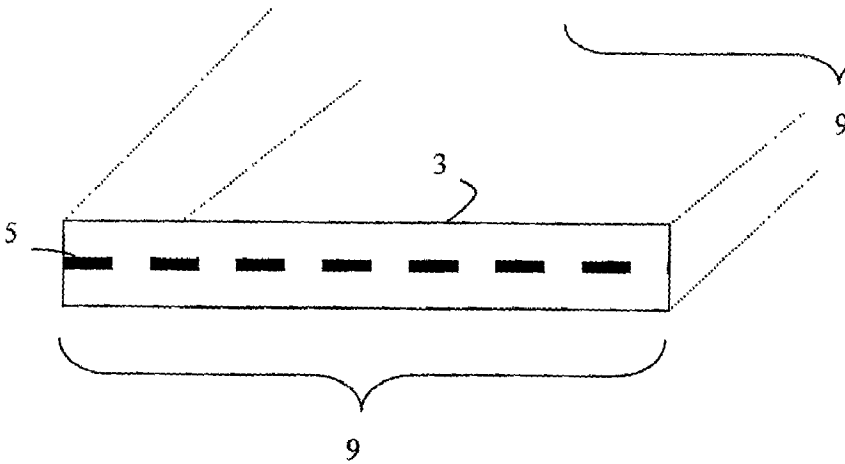
FIG. 29A is a simplified top view of the airport runway surface illustrating where optical laser would provide protection for aircraft in landing and take off sections of the airport runway surface.

FIG. 29 is a top view of the entire airport runway surface 3, with an equal number of optical laser transceivers 11, and of optical laser reflectors 12 located across the width of the airport runway surface 3 from each other. Optical laser reflectors 12 are located along the entire length of the airport runway surface 3 opposite of the optical laser transceivers 11. The optical laser beam 4 configuration covers both the width and length of the airport runway surface 3. The optical laser beams 4 are in both constant directions which travel from the optical laser transceivers 11 to the optical laser reflectors 12 traveling through several different planes. This configuration can either be set-up in sections down the entire airport runway surface 3 covering small sections, or can be configured in one large pattern to encompass the entire airport runway surface 3. Optical laser transmitters 1 and receivers 2 may also be used in conjunction with optical laser reflectors 12 and/or optical laser transceivers 11. FIG. 29A is a simplified top view of the airport runway surface 3 illustrating where optical laser beam 4 would provide protection for aircraft within landing and take off sections 9 of the airport runway surface 3.

EXAMPLE 27

Figure 30:
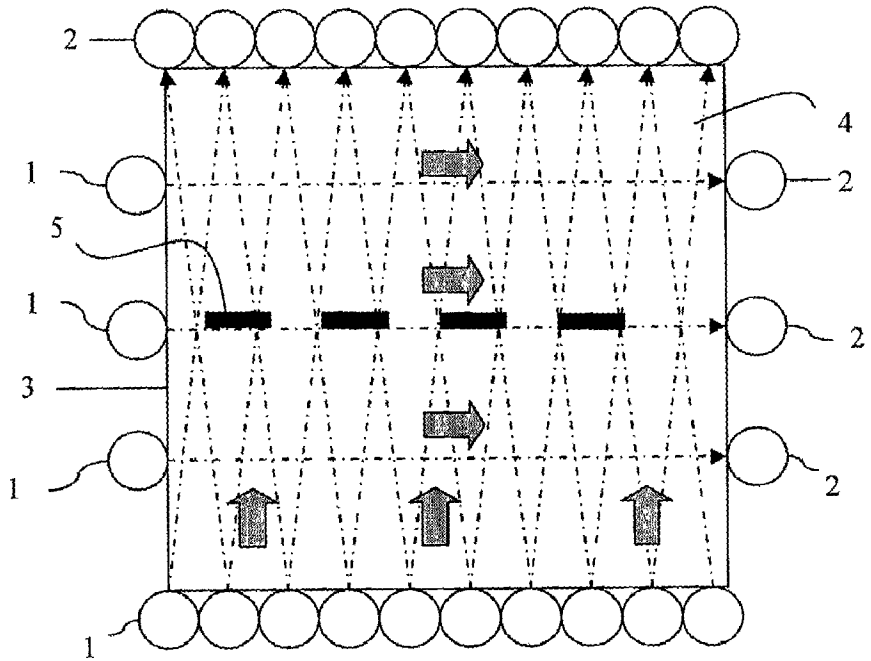
FIG. 30 is a top view of the airport runway surface with optical laser embodiments present on both sides of the width showing a laser beam configuration covering length and width of area specified in one direction constantly traveling through several different planes.
Figure 30A:
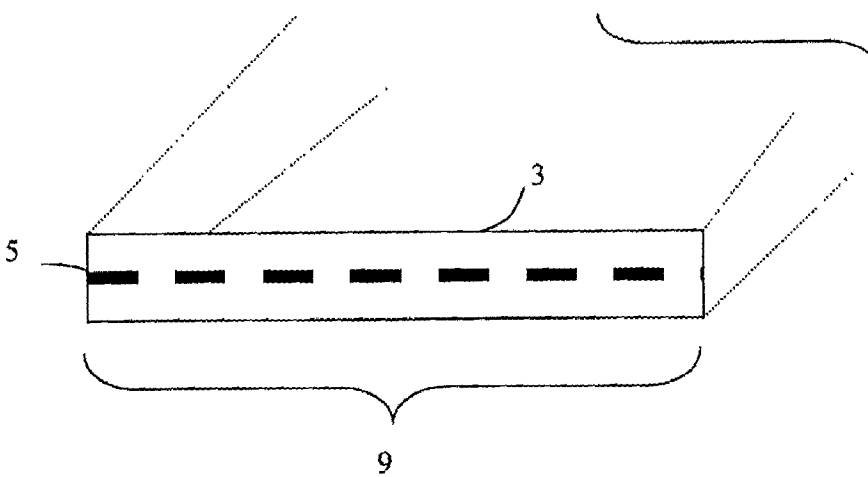
FIG. 30A is a simplified top view of the airport runway surface illustrating where optical laser would provide protection for aircraft in landing and take off sections of the airport runway surface.

FIG. 30 is a top view of the entire airport runway surface 3, with an equal number of optical laser transmitters 1, and of optical laser receivers 2 located across from each other over the width and length of the of the airport runway surface 3. Optical laser receivers 2 are located along the entire length and width of the airport runway surface 3 opposite of the optical laser transmitters 1. The optical laser beam 4 configuration covers both the width and length of the airport runway surface 3. The optical laser beams 4 are in one constant direction which travel from the optical laser transmitters 1 to the optical laser receivers 2 traveling through several different planes over the width of the airport runway surface 3. The optical laser beams 4 may also travel in both constant directions which travel from the optical laser transmitters 1 to the optical laser receivers 2 traveling through several different planes over the length of the airport runway surface 3. This configuration can either be set-up in sections down the entire airport runway surface 3 covering small sections, or can be configured in one large pattern to encompass the entire airport runway surface 3. FIG. 30A is a simplified top view of the airport runway surface 3 illustrating where optical laser beams 4 would provide protection for aircraft within landing and take off sections 9 of the airport runway surface 3.

EXAMPLE 28

Figure 31:
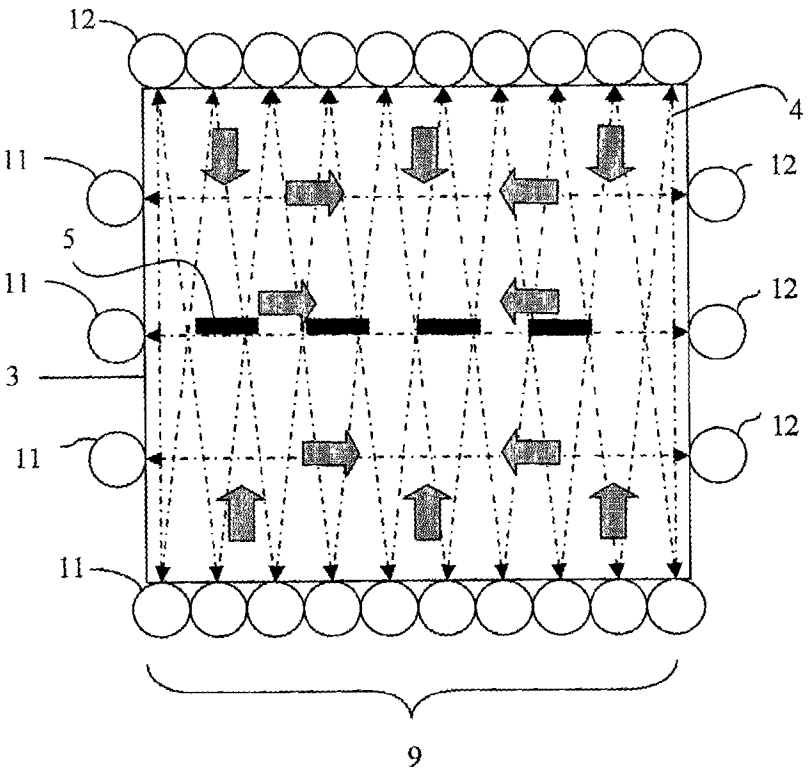
FIG. 31 is a top view of the airport runway surface with optical laser embodiments present on both sides of the width showing a laser beam configuration covering length and width of area specified in two directions constantly traveling through several different planes.
Figure 31A:
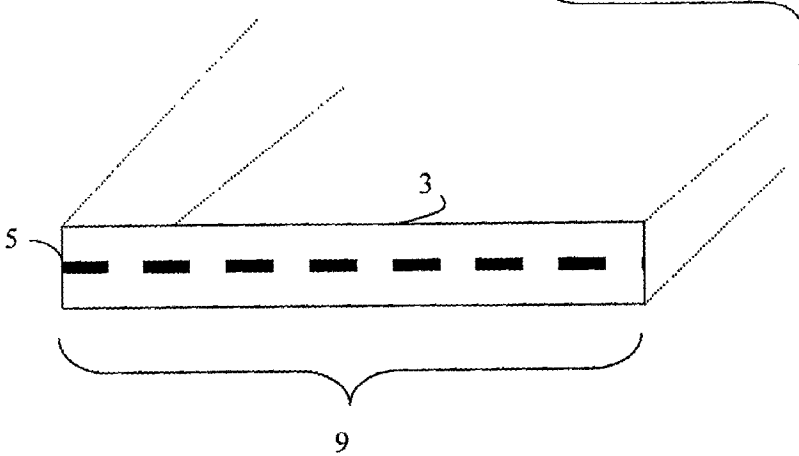
FIG. 31A is a simplified top view of the airport runway surface illustrating where optical laser would provide protection for aircraft in landing and take off sections of the airport runway surface.

FIG. 31 is a top view of the entire airport runway surface 3, with an equal number of optical laser transceivers 11, and of optical laser reflectors 12 located across the width and length of the of the airport runway surface 3 from each other. Optical laser reflectors 12 are located along the entire length and width of the airport runway surface 3 opposite of the optical laser transceivers 11. The optical laser beam 4 configuration covers both the width and length of the airport runway surface 3. The optical laser beams 4 are in both constant directions which travel from the optical laser transceivers 11 to the optical laser reflectors 12 traveling through several different planes over the width of the airport runway surface 3. The optical laser beams 4 are in both constant directions which travel from the optical laser transceiver 11 to the optical laser reflectors 12 traveling through several different planes over the length of the airport runway surface 3. This configuration can either be set-up in sections down the entire airport runway surface 3 covering small sections, or can be configured in one large pattern to encompass the entire airport runway surface 3. FIG. 31A is a simplified top view of the airport runway surface 3 illustrating where optical laser beams 4 would a provide protection for aircraft within landing and take off sections 9 of the airport runway surface 3.

EXAMPLE 29

Figure 32:
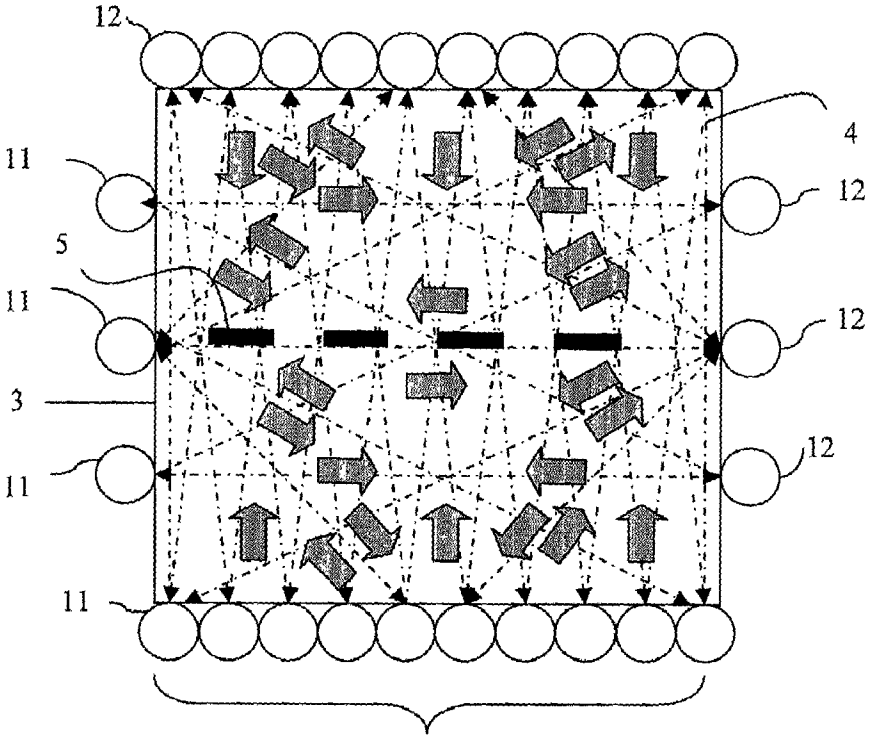
FIG. 32 is a top view of the airport runway surface with optical laser embodiment present on both sides of the width showing a laser beam configuration covering length, width, and diagonal regions of specified area in two directions constantly traveling through several different planes.
Figure 32A:
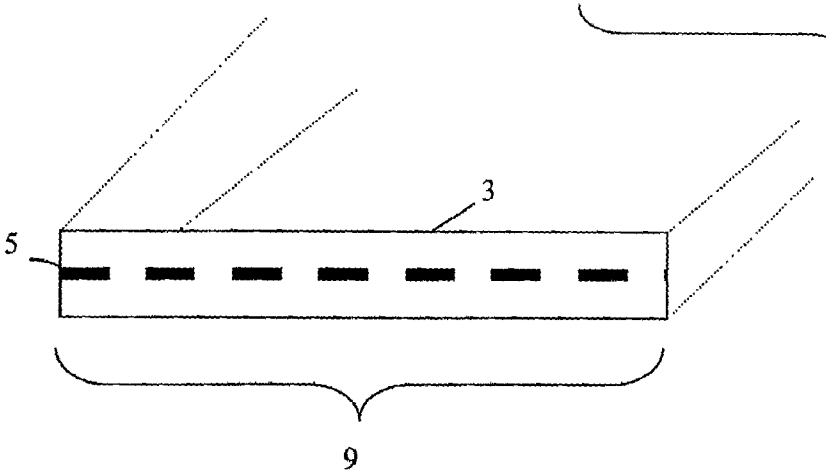
FIG. 32A is a simplified top view of the airport runway surface illustrating where optical laser would provide protection for aircraft in landing and take off sections of the airport runway surface.

FIG. 32 is a top view of the entire airport runway surface 3, with an equal number of optical laser transceivers 11, and of optical laser reflectors 12, located across from each other along the width and length of the of the airport runway surface 3. Optical laser reflectors 12 are located along the entire length and width of the airport runway surface 3 opposite of the optical laser transceivers 11. The optical laser beam 4 configuration covers both the width and length of the airport runway surface 3. The optical laser beams 4 are in every possible constant direction which travels from the optical laser transceivers 11 to the optical laser reflectors 12 traveling through several different planes over the width of the airport runway surface 3. The optical laser beams 4 are in both constant directions which travel from the optical laser transceivers 11 to the optical laser reflectors 12 traveling through several different planes over the length of the airport runway surface 3. This configuration can either be set-up in sections down the entire airport runway surface 3 covering small sections, or can be configured in one large pattern to encompass the entire airport runway surface 3. FIG. 32A is a simplified top view of the airport runway surface 3 illustrating where optical laser beams 4 would provide protection for aircraft within landing and take off sections 9 of the airport runway surface 3.

The invention is described in detail with respect to preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

I claim:

1. An apparatus for detecting objects on an airport runway, comprising:

a plurality of transmitters adapted to emit incident beams and positioned along a first side of said airport runway;

a plurality of receivers adapted to receive said incident beams and positioned along a second side of said runway;

a processor operably linked to each of said plurality of receivers; and a user interface operably linked to said processor, wherein each of said plurality of transmitters are adapted to emit said incident beams across at least a portion of said runway, and each of said plurality of receivers being configured to receive one of said incident beams, wherein said plurality of receivers are adapted to indicate a first indication to said processor if any of said incident beams are interrupted by an object on or over said runway, wherein said processor is adapted to send a second indication to said user interface in response to said first indication, said second indication being a warning indication; and wherein said user interface is adapted to enable a user to receive a third indication in response to said second indication further comprising a reflector positioned adjacent to said runway, wherein said reflector is adapted to reflect said incident beams from said plurality of transmitters to said plurality of receivers.

2. The apparatus of claim 1, wherein one of said plurality of receivers and one of said plurality of transmitters are adapted to form a first transceiver.

3. The apparatus of claim 1, further comprising a support mechanism adapted to support each of said plurality of receivers.

4. The apparatus of claim 3, wherein said support mechanism is adapted to present a substantially flush surface.

5. The apparatus of claim 1, further comprising a support mechanism adapted to support each of said plurality of transmitters.

6. The apparatus of claim 5, wherein said support mechanism is adapted to present a substantially flush surface.

7. The apparatus of claim 1, further comprising a protective cover adapted to protect each of said plurality of receivers.

8. The apparatus of claim 1, further comprising a protective cover adapted to protect each of said plurality of transmitters.

9. The apparatus of claim 1, further comprising a heating element adapted to heat each of said plurality of receivers.

10. The apparatus of claim 1, further comprising a heating element adapted to heat each of said plurality of transmitters.

11. The apparatus of claim 1, wherein said processor is adapted to use triangulation to locate said object on said runway.

12. An apparatus for detecting objects on an airport runway, comprising:

a plurality of transmitters adapted to emit incident beams positioned along a first side of said runway;

a plurality of receivers adapted to receive said incident beams, said plurality of receivers being positioned along a second side of said runway;

a processor for detecting a status of said incident beams and operably linked to each of said plurality of receivers; and a user interface operably linked to said processor; each of said plurality of transmitters being adapted to emit an incident beam not substantially parallel to said first or second sides, each of said plurality of receivers being adapted to receive said incident beam from any one of said plurality of transmitters, each of said plurality of receivers being adapted to indicate a first indication to said processor if any of said incident beams are interrupted by an object on or over said runway, said processor being adapted to send a second indication to said user interface in response to said first indication, said second indication being a warning indication, and said user interface being adapted to enable a user to receive a third indication in response to said warning indication further comprising a reflector positioned adjacent to said runway, wherein said reflector is adapted to reflect said incident beams from said plurality of transmitters to said plurality of receivers.

13. The apparatus of claim 12, wherein one of said plurality of receivers and one of said plurality of transmitters are adapted to form a transceiver.

14. The apparatus of claim 12, further comprising a support mechanism adapted to support each of said plurality of receivers.

15. The apparatus of claim 14, wherein said support mechanism is adapted to present a substantially flush surface.

16. The apparatus of claim 12, further comprising a support mechanism adapted to support each of said plurality of transmitters.

17. The apparatus of claim 16, wherein said support mechanism is adapted to present a substantially flush surface.

18. The apparatus of claim 12, further comprising a protective cover adapted to protect each of said plurality of receivers.

19. The apparatus of claim 12, further comprising a protective cover adapted to protect each of said plurality of transmitters.

20. The apparatus of claim 12, further comprising a heating element adapted to heat each of said plurality of receivers.

21. The apparatus of claim 12, further comprising a heating element adapted to heat each of said plurality of transmitters.

22. The apparatus of claim 12, further comprising:

wherein said processor is adapted to use triangulation to locate said object on said runway.

23. An apparatus for detecting objects on an airport runway, having an axial direction and a length that is substantially longer than a width of the runway, comprising:

an array of a plurality of transmitters, each of said transmitters being adapted to emit incident beams, and disposed along a first side of said airport runway, an array of a plurality of receivers, each of said receivers being adapted to receive said incident beams, and disposed along a second side of said airport runway opposite said first side;

each of said plurality of transmitters being associated with at least one of said plurality of receivers;

a processor for detecting a status of said incident beam, said processor being operably linked to each of said plurality of receivers, said processor including an item characterizer and an alarm generator; and a user interface operably linked to said processor; each of said plurality of transmitters being adapted to emit an incident beam substantially transverse to said axial direction of said runway and not substantially parallel to said first or second sides; each of said plurality of receivers being adapted to receive said incident beam from any one of said plurality of transmitters and configured to provide a first indication to said processor if said incident beam is interrupted by any object that appears on said runway; said processor being adapted to triangulate to determine said location of said object on said runway and further identify a characteristic of said object on said runway with said item characterizer, and send a warning indication through said alarm generator to said user interface in response to said first indication; said user interface being adapted to enable a user to receive a second indication in response to said warning indication; said second indication being adapted to inform said user of a location of said object and the type of said object detected on said runway further comprising a reflector positioned adjacent to said runway, wherein said reflector is adapted to reflect said incident beams from said plurality of transmitters to said plurality of receivers.

24. The apparatus of claim 23, wherein one of said plurality of receivers and one of said plurality of transmitters are adapted to form a transceiver.

25. The apparatus of claim 23, further comprising a support mechanism adapted to support each of said plurality of receivers.

26. The apparatus of claim 25, wherein said support mechanism is adapted to present a substantially flush surface.

27. The apparatus of claim 23, further comprising a support mechanism adapted to support each of said plurality of transmitters.

28. The apparatus of claim 27, wherein said support mechanism is adapted to present a substantially flush surface.

29. The apparatus of claim 23, further comprising a protective cover adapted to protect each of said plurality of receivers.

30. The apparatus of claim 23, further comprising a protective cover adapted to protect each of said plurality of transmitters.

31. The apparatus of claim 23, further comprising a heating element adapted to heat each of said plurality of receivers.

32. The apparatus of claim 23, further comprising a heating element adapted to heat each of said plurality of transmitters.

* * * * *